United States Patent [19]

Iwasa

[11] Patent Number: 4,755,455

[45] Date of Patent: Jul. 5, 1988

[54] SILVER HALIDE COLOR PHOTOGRAPHIC MATERIALS

[75] Inventor: Yasuo Iwasa, Kanagawa, Japan

[73] Assignee: Fuji Photo Film Co., Ltd., Kanagawa, Japan

[21] Appl. No.: 886,863

[22] Filed: Jul. 18, 1986

[30] Foreign Application Priority Data

Jul. 19, 1985 [JP] Japan ..... 60-159969

[51] Int. Cl.[4] ..... G03C 7/38; G03C 1/02; G03C 7/26

[52] U.S. Cl. ..... 430/558; 430/550; 430/567

[58] Field of Search ..... 430/567, 558, 571, 386, 430/387

[56] References Cited

U.S. PATENT DOCUMENTS 4,063,951 12/1977 Bogg ..... 430/569
4,414,306 11/1983 Wey et al. ..... 430/434
4,559,297 12/1985 Seto et al. ..... 430/558
4,581,329 4/1986 Sugimoto et al. ..... 430/567

FOREIGN PATENT DOCUMENTS 2110405 6/1983 United Kingdom ..... 430/567

OTHER PUBLICATIONS

V. L. Zelikman and S. M. Levi, *Making and Coating Photographic Emulsions,* The Focal Press, pp. 203–207.

*Primary Examiner*—Paul R. Michl
*Assistant Examiner*—Mark R. Buscher
*Attorney, Agent, or Firm*—Sughrue, Mion, Zinn, Macpeak and Seas

[57] ABSTRACT

Siliver halide color photographic materials are disclosed which have high color-reproducibility and high color image-fastness and which are substantially free from variation with respect to sensitivity, gradation or color density as caused by variation of various factors in the development of the materials such as variation of the composition of the treating solution, the treating time or the treating temperature.

The present silver halide color photographic materials have at least one silver halide emulsion layer on a support and are characterized in that silver halide grains contained in the emulsion layer comprise silver bromide or silver bromochloride, about 50% or more of the total projected area of said silver halide grains are composed of tabular grains having an average aspect ratio of about 5 or more particularly 5 to 8, and the emulsion layer further contains at least one pyrazoloazole-type magenta coupler represented by general formula (I):

(I)

wherein $R^1$ represents a hydrogen atom or a substituent;

X represents a hydrogen atom or a group capable of being removed by a coupling reaction with an oxidized form of an aromatic primary amine developing agent;

Zb and Zc each represents a methine or substituted methine residue or =N— or —NH—;

Za represents =N— or —NH—;

one of the Za-Zb bond and the Zb-Zc bond is a double bond, and the other is a single bond; and if the Zb-Zc is a carbon-carbon double bond, this may form a part of an aromatic ring;

$R^1$ or X may form a dimer or a polymer; and if Za, Zb or Zc is a substituted methine residue, this may form a dimer or a polymer.

11 Claims, No Drawings

SILVER HALIDE COLOR PHOTOGRAPHIC MATERIALS

FIELD OF THE INVENTION

The present invention relates to silver halide color photographic materials, and more precisely, to those which have high color-reproducibility and high color image-fastness and which are substantially free from variation with respect to sensitivity, gradation or color density as caused by the influence of various factors in the development of the materials such as variation of the composition of the treating solution, the treating time or the treating temperature.

BACKGROUND OF THE INVENTION

It is well knowun to use silver halide color photographic materials to form desired images by exposure and development. In many cases, a system employing a light-sensitive silver halide emulsion and a so-called dye-forming coupler capable of forming a dye by reaction with an oxidized form of an aromatic primary amine developing agent (hereinafter referred to as a "coupler" in short) is utilized. Above all, a combination of a yellow coupler, a cyan coupler and a magenta coupler is generally used in the color photographic materials.

Among these, magenta dyes obtained from a 5-pyrazolone-type coupler, which has mainly been used as a magenta coupler, have serious problems with regard to to color-reproducibility since magenta dyes show multiple absorption near 430 nm and that the leg portion curve in a long wavelength range is dull.

In order to overcome these defects, pyrazoloazole-type couplers have been developed, as described, for example, in Japanese Patent Application (OPI) No. 162548/84, No. 171956/84, No. 33552/85 and No. 43659/85 and U.S. Pat. No. 3,061,432 (The term "OPI" as used herein means an "unexamined published application".). Magenta dyes obtained by coupling of this type of coupler with an oxidized form of an aromatic primary amine developing agent do not show any multiple absorption near 430 nm in an ethyl acetate solution but may exhibit a magenta color of high purity, and the leg portion curve of the absorption in a long wavelength range is good, which is a characteristic feature of these magenta dyes. In addition, the color images thus obtained have good light-fastness.

On the other hand, it is extremely important for silver halide photographic materials to have stable photographic characteristics in view of different variations of development conditions. In a conventional developing process, variations among various factors such as the amount of photographic materials treated, the amount of developers to be replenished, the temperature of the developers and the treating time occur frequently, and these variations will affect the photographic characteristics of the treated photographic materials such as the sensitivity, gradation or color density thereof.

SUMMARY OF THE INVENTION

The present inventors have repeatedly studied various combinations of silver halide emulsions and pyrazoloazole-type couplers with respect to comparing the variation of the photographic characteristics of developed silver halide color photographic materials in view of the variation of the treatment factors mentioned above. As a result, we have found that silver halide color photographic materials formed by the combination of a silver bromide or silver bromochloride emulsion and a pyrazoloazole-type coupler are often accompanied by some larger variations of the photographic characteristics due to differing treatment factors than those formed by the combination of the same type of emulsion and a 5-pyrazolone-type coupler.

Pyrazoloazole-type magneta couplers represented by the following formula (I) are extremely excellent couplers in that the color images obtained therefrom are substantially free from any unnecessary absorption in the blue-light range and the red-light range, the color-reproducibility is advantageous, and in addition, there is less occurrence of yellow stains when the color images are preserved under light-irradiation or high-moisture. However, when this type of coupler was combined with a conventional silver bromide emulsion or silver bromochloride emulsion, photographic materials having stable photographic characteristics could not be obtained because of the variation of the treatment factors.

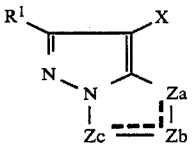

(I)

In formula (I), $R^1$ represents a hydrogen atom or a substituent; X represents a hydrogen atom or a group capable of being removed by a coupling reaction with an oxidized form of an aromatic primary amine developing agent; Zb and Zc each represent a methine or substituted methin residue or =N— or —NH—; Za represents =N— or —NH—; one of the Za-Zb bond and the Zb-Zc bond is a double bond, and the other is a single bond; and if the Zb-Zc bond is a carbon-carbon double bond, this may form a part of an aromatic ring; $R^1$ or X may form a dimer or a polymer; and if Zb or Zc is a substituted methine, this may form a dimer or a polymer.

Accordingly, an object of the present invention is to provide a silver halide color photographic material of excellent color-reproducibility, which comprises a silver bromide or silver bromochloride and which may form magenta color images having good light absorption-characteristic.

Another object of the present invention is to provide a silver halide color photographic material comprising silver bromide or silver bromochloride, which may form color images of high light-fastness in a dark or under light-exposure and which are free from occurrence of yellow stains.

A further object of the present invention is to provide a silver halide color photographic material comprising silver bromide or silver bromochloride, which may form stable color images with less variation in photogrpahic characteristics due to the variation of development factors.

These and other objects of the present invention may be attained by the provision of novel silver halide color photographic materials having at least one silver halide emulsion layer on a support, wherein silver halide grains in the emulsion layer comprise silver bromide or silver bromochloride, about 50% or more of the total projected area of the silver halide grains are composed of tabular grains having an average aspect ratio of about 5 or more and the emulsion layer contains at least one pyrazoloazole-type magenta coupler of the aforesaid general formula (I).

DETAILED DESCRIPTION OF THE INVENTION

The objects of the present invention as mentioned above may be achieved by the specific use of the tabular silver halide grains having an average aspect ratio of about 5 or more in a specific system containing silver bromide or silver bromochloride and containing the specifically defined pyrazoloazole-type magenta coupler as represented by the above general formula (I). However, other pyrazoloazole-type magneta couplers having a skeleton of the following general formulae (a) or (b) (in which the groaup corresponding to "Za" in the formula (I) is a methine or substituted methine group) could not attain the above-described effect of the present invention.

(a)

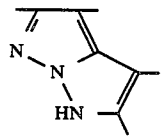

(b)

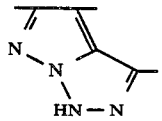

Further, other type of silver halide such as silver bromoiodide containing a substantial amount of iodine could not attain the above-described effect of the present invention.

Where there is a combination of the pyrazoloazole-type coupler of the formula (I) and a silver halide emulsion comprising tabular grains having an average aspect ratio of less than about 5 or grains of any other crystalline form, the variation of the color density of the formed images due to the influence of various factors in the development was larger when the content of silver chloride in the photographic emulsion was increased.

In the tabular silver halide grain-containing emulsion to be used in the present inventin, the "average aspect ratio" means an average of a ratio of the thickness to the diameter of the silver halide grains, where the diameter designates the diameter of a circle having the same area as the projected area of the grain, when the silver halide emulsion is observed with a microscope or electron microscope. Accordingly, the definition that the average aspect ratio is about 5 or more means that the diameter of the circle is larger than the thickness of the grain by about 5 times or more.

The tabular silver halide grains to be used in the silver halide emulsion of the present invention have a grain diameter larger than the grain thickness by about 5 times or more, preferably 5–30 times, more preferably 5–8 times. In addition, the proportion of the tabular silver halide grains in the projected area of the total silver halide grains is about 50% or more, preferably 70% or more and most preferably 85% or more.

The tabular silver halide grains to be used in the present invention comprise silver bromide or silver bromochloride, more preferably silver bromochloride containing from about 40 mole% to about 95 mole% of silver bromide, and the composition distribution in the silver bromochloride may be either uniform or localized. The halogen composition may vary continuously or non-continuously from the center part to the outer part of the tabular grains. In addition, the halogen composition may vary continuously or non-continuously in the direction of the thickness of the tabular grains.

If desired, two or more kinds of tabular grains each comprising a different halogen composition may be blended and used.

The diameter of the tabular silver halide grains is from about 0.1 to about 10 μm, preferably 0.2 to 5.0 μm, especially preferably 0.3 to 2.0 μm. The thickness of the grains is preferably about 0.3 μm or less.

The thickness of the grains is represented by the distance between the two parallel surfaces constituting the tabular silver halide grains.

More preferred tabular silver halide grains to be used in the present invention are those having a grain diameter of from 0.2 to 5.0 μm, a grain thickness of 0.3 μm or less and a ratio of average diameter/average thickness of from 5 to 8. Especially preferred silver halide photographic emulsions are those where 85% or more of the total projected area of the total silver halide grains contains grains having a grain diameter of from 0.3 to 2.0 μm and a ratio of average diameter/average thickness of 5 or more.

The grain size distribution of the tabular silver halide grains to be used in the present invention may be either broad or narrow.

If desired, two or more kinds of tabular grains each having a different grains size may be blended and used, in accordance with the photographic gradation as required.

Examples of plate-like silver halide grain-containing emulsions to be used in the present invention are described in Duffin, *Photographic Emulsion Chemistry,* by Focal Press Co., New York, 1966, pp. 66–72, and *Photo. Journal,* 80, p. 285 et seq. (edited by A. P. H. Trivelli and W. F. Smith, 1940), and these may easily be prepared by reference to the methods as described in Japanese Patent Application (OPI) Nos. 113927/83, 113928/83, 113926/83, 113930/83, 113934/83 and 127921/83.

For instance, seed crystals containing 40% by weight or more of tabular grains are first formed in an atmosphere of a relatively high pAg value having a pBr value of 1.3 or less, and then a silver nitrate solution and an alkali halide solution are simultaneously added thereto to grow the seed crystals while the pBr value is kept the same. The desired grains are thus obtained. It is desirous to add the silver nitrate solution and the alkali halide solution in these growing steps so as to prevent the formation of any new crystal nuclei.

The size of the tabular silver halide grains may properly be regulated by appropriately controlling the temperature, the selection of the kind or quality of solvents and the addition rate of the silver salts and halides to be used in the growth of the grains.

In the manufacture of the tabular silver halide grains of the present invention, a silver halide solvent may be used if desires, whereby the grain size, the shape of the grains (such as ratio of diameter/thickness), the grain size distribution and the growth rate of the grains may properly be controlled. The amount of the solvent to be used is preferably within the range of about $10^{-4}$ to about 1.0 wt.% of the reaction solution, especially preferably from $10^{-3}$ to $10^{-1}$ wt.%. In the present invention, the grain size distribution may be made monodispersed and the growth rate of the grains may be accelerated by increasing the amount of the solvent used, while the thickness of the grains is apt to increase by increasing the amount of the solvent used.

In the present invention, any conventional silver halide solvents may be used. Preferred silver halide solvents include ammonia, thioethers, thioureas, thiocyanates and thiazolinthiones. Regarding thioethers, U.S. Pat. No. 3,271,157, No. 3,574,628 and No. 3,790,387 may be referred to. For examples of thioureas, Japanese Patent Application (OPI) No. 82408/78 and No. 77737/80 may be referred to; for example of thiocyanates, U.S. Pat. No. 2,222,264, No. 2,448,534 and No. 3,320,069 may be referred to; and for examples of thiazolin-thiones, Japanese Patent Application (OPI) No. 144319/78 may be referred to.

In the formation of the silver halide grains or the physical ripening thereof, a cadmium salt, a zinc salt, a lead salt, a thallium salt, an iridium salt or a complex thereof, a rhodium salt or a complex thereof or an iron salt or a complex thereof may be used at the same time.

In the manufacture of the tabular silver halide grains to be used in the present invention, means for increasing the addition speed, the amount and the concentration of the silver salt solution (such as $AgNO_3$ aqueous solution) to be added for the acceleration of the growth of the grains and the halide solution (such as KBr aqueous solution) are preferably employed. Examples of these means are described in British Pat. No. 1,335,925; U.S. Pat. No. 3,650,757, Np. 3,672,900 and No. 4,242,445; and Japanese Patent Application (OPI) No. 142329/80 and No. 158124/80.

The tabular silver halide grains of the present invention may optionally be chemically-sensitized, if desired.

Different methods for performing chemical-sensitization may be used including: sulfur-sensitization using a sulfur-containing compound capable of reacting with an active gelatin or silver (such as thiosulfates, thioureas, mercapto compounds, rhodanines); reductive sensitization using a reducing substance (such as stannous salts, amines, hydrazine derivatives, formamidine-sulfinic acids, silane compounds); or a noble metal-sensitization using a noble metal compound (such as gold complexes as well as Pt-, Ir-, Pd- or the like group VIII metal complexes). These methods may be utilized singly or in combination.

Examples of these means are described in various publications; for example, the sulfur-sensitization is described in U.S. Pat. Nos. 1,574,944, No. 2,278,947, No. 2,410,689, No. 2,728,668 and No. 3,656,955; the reductive sensitization is described in U.S. Pat. Nos. 2,419,974, No. 2,983,609 and No. 4,054,458; and the noble metal-sensitization is described in U.S. Pat. Nos. 2,399,083 and No. 2,448,060 and British Pat. No. 618,061.

Since it is especially desirous to reduce the amount of silver to be used, the tabular silver halide grains of the present invention are preferably subjected to gold-sensitization or sulfur-sensitization or a combination thereof.

The tabular silver halide grains of the present invention may optionally be spectrally-sensitized with methine dyes or other dyes, if desired.

Usable dyes therefor include cyanine dyes, merocyanine dyes, complex cyanine dyes, complex merocyanine dyes, holopolar-cyanine dyes, hemicyanine dyes, styryl dyes and hemioxonole dyes. Especially useful dyes are those belonging to the classes of cyanine dyes, merocyanine dyes and complex merocyanine dyes.

Examples of these useful sensitizing dyes are described, for example, in German Pat. No. 929,080; U.S. Pat. Nos. 2,493,748, 2,503,776, 2,519,001, 2,912,329, 3,656,959, 3,672,897 and 4,025,349; British Pat. No. 1,242,588; and Japanese Patent Publication No. 14030/69. Any of these sensitizing dyes may be used in the present invention.

Further, these sensitizing dyes may be used either singly or in combination, and combinations are often utilized especially for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,814,609 and 4,026,707; British Pat. No. 1,344,281; Japanese Patent Publication No. 4936/68 and No. 12375/78; and Japanese Patent Application (OPI) No. 109925/77 and No. 110618/77.

The pyrazoloazole compounds to be used in the present invention will be explained in more detail hereinafter.

The polymers of the formula (I) include polymers containing two or more groups of the formula (I) in one molecule, including biscompounds and polymer-couplers. The polymer-couplers may be homopolymers comprising monomers only, which have part of the general formula (I), preferably those having a vinyl group (hereinafter referred to as vinyl monomers) or otherwise may be copolymers as formed by copolymerization with some other non-coloring ethylenic monomers which are not coupled with an oxidized form of an aromatic primary amine developing agent.

Among the pyrazoloazole-type magenta complers of the general formula (I), preferred couplers are those as represented by the following general formulae (II), (III), (IV), (V) and (VI).

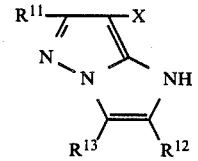

(II)

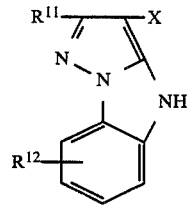

(III)

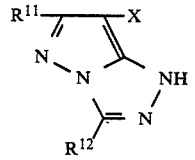

(IV)

-continued

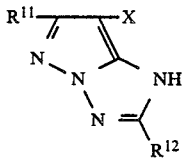

(V)

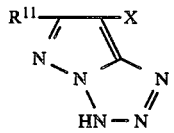

(VI)

Among the couplers of the above general formulae (II) through (VI), those of the formulae (II), (IV) and (V) are preferred for obtaining the objects of the present invention, and especially preferred couplers are those of the formula (V).

In the general formulae (II) through (VI), $R^{11}$, $R^{12}$, and $R^{13}$ may be the same or different and each represents a hydrogen atom, a halogen atom, an alkyl group, an aryl group, a heterocyclic group, a cyano group, an alkoxy group, an aryloxy group, a heterocyclic-oxy group, an acyloxy group, a carbamoyloxy group, a silyloxy group, a sulfonyloxy group, an acylamino group, an anilino group, an ureido group, an imido group, a sulfamoylamino group, a carbamoylamino group, an alkylthio group, an arylthio group, a heterocyclic-thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; X represents a hydrogen atom, a halogen atom or a carboxyl group or represents a group which is bonded with the carbon atom in the coupling-position via an oxygen atom, nitrogen atom or sulfur atom and which may be removed by a coupling reaction; and $R^{11}$, $R^{12}$, $R^{13}$ or X may be a divalent group to form a bis-form coupler.

These couplers of the formulae (II) through (VI) may be polymer-couplers containing the coupler residue of the formulae (II) through (VI) in the main chain or in the side chain thereof. In particular, polymers derived from vinyl monomers having the structure represented by these formulae are preferred. In the case of such polymer-couplers, $R^{11}$, $R^{12}$, $R^{13}$ or X represents a vinyl group or a binding group.

More precisely, $R^{11}$, $R^{12}$ and $R^{13}$ each represents a hydrogen atom, a halogen atom (such as a chlorine or a bromine atom), an alkyl group (such as a methyl group, a propyl group, a t-butyl group, a trifluoromethyl group, a tridecyl group, a 3-(2,4-di-t-amylphenoxy)propyl group, an allyl group, a 2-dodecyloxyethyl group, a 3-phenoxypropyl group, a 2-hexylsulfonyl-ethyl group, a cyclopentyl group or a benzyl group), an aryl group (such as a phenyl group, a 4-t-butylphenyl group, a 2,4-di-t-amylphenyl group or a 4-tetradecanamidophenyl group), a heterocyclic group (such as a 2-furyl group, a 2-thienyl group, a 2-pyrimidinyl group or a 2-benzothiazolyl group), a cyano group, an alkoxy group (such as a methoxy group, an ethoxy group, a 2-methoxyethoxy group, a 2-dodecyloxyethoxy group or a 2-methanesulfonylethoxy group), an aryloxy group (such as a phenoxy group, a 2-methylphenoxy group or a 4-t-butylphenoxy group), a heterocyclic-oxy group (such as a 2-benzimidazolyloxy group), an acyloxy group (such as an acetoxy group or a hexadecanoyloxy group), a carbamoyloxy group (such as an N-phenylcarbamoyloxy group or an N-ethylcarbamoyloxy group), a silyloxy group (such as a trimethylsilyloxy group), a sulfonyloxy group (such as a dodecylsulfonyloxy group), an acylamino group (such as an acetamido group, a benzamido group, a tetradecanamido group, an α-(2,4-di-t-amylphenoxy)butylamido group, a γ-(3-t-butyl-4-hydroxyphenoxy)-butylamido group or an α-{(4-hydroxyphenylsulfonyl)phenoxy}decanamido group), an anilino group (such as a phenylamino group, a 2-chloroanilino group, a 2-chloro-5-tetradecanamidanilino group, a 2-chloro-5-dodecyloxycarbonylanilino group, an N-acetylanilino group or a 2-chloro-5-{α-(3-t-butyl-4-hydroxyphenoxy)-dodecanamido}anilino group), an ureido group (such as a phenylureido group, a methylureido group, or an N,N-dibutyl-ureido group), an imido group (such as an N-succinimido group, a 3-benzylhydantoinyl group or a 4-(2-ethylhexanoylamino)phthalimido group), a sulfamoylamino group (such as an N,N-dipropylsulfamoylamino group or an N-methyl-N-decylsulfamoylamino group), an alkylthio group (such as a methylthio group, an octylthio group, a tetradecylthio group, a 2-phenoxyethylthio group, a 3-phenoxypropylthio group or a 3-(4-t-butylphenoxy)-propylthio group), an arylthio group (such as a phenylthio group, a 2-butoxy-5-t-octylphenylthio group, a 3-pentadecylphenylthio group, a 2-carboxyphenylthio group or a 4-tetradecanamidophenylthio group), a heterocyclic-thio group (such as a 2-benzothiazolylthio group), an alkoxycarbonylamino group (such as a methoxycarbonylamino group or a tetradecyloxycarbonylamino group), an aryloxycarbonylamino group (such as a phenoxycarbonylamino group or a 2,4-di-tert-butylphenoxycarbonylamino group), a sulfonamido group (such as a methanesulfonamido group, a hexadecanesulfonamido group, a benzenesulfonamido group, a p-toluenesulfonamido group, an octadecanesulfonamido group or a 2-methyloxy-5-t-butylbenzenesulfonamido group), a carbamoyl group (such as an N-ethylcarbamoyl group, an N,N-dibutylcarbamoyl group, an N-(2-dodecyloxyethyl)carbamoyl group, an N-methyl-N-dodecylcarbamoyl group or an N-{3-(2,4-di-tert-amylphenoxy)propyl}carbamoyl group), an acyl group (such as an acetyl group, a (2,4-di-tert-amylphenoxy)acetyl group or a benzoyl group), a sulfamoyl group (such as an N-ethylsulfamoyl group, an N,N-dipropylsulfamoyl group, an N-(2-dodecyloxyethyl)sulfamoyl group, an N-ethyl-N-dodecylsulfamoyl group or an N,N-diethylsulfamoyl group), a sulfonyl group (such as a methanesulfonyl group, an octanesulfonyl group, a benzenesulfonyl group or a toluenesulfonyl group), a sulfinyl group (such as an octanesulfinyl group, a dodecylsulfinyl group or a phenylsulfinyl group) an alkoxycarbonyl group (such as a methoxycarbonyl group, a butyloxycarbonyl group, a dodecyloxycarbonyl group, an octadecyloxycarbonyl group or a 3-pentadecyloxycarbonyl group), an aryloxycarbonyl group (such as a phenyloxycarbonyl group; and X represents a hydrogen atom, a halogen atom (such as a chlorine atom, a bromine atom, or an iodine atom), a carboxyl group, or a group to be bonded via an oxygen atom (such as an acetoxy group, a propanoyloxy group, a benzoyloxy group, a 2,4-dichlorobenzoyloxy group, an ethoxyoxazoloyloxy group, a pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenetyloxy group, a 2-phenoxyethoxy group, a 5-phenyltetrazolyloxy group or a 2-benzothiazolyloxy group), a group to be bonded via a nitrogen atom (such as a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoyl group, a 1-piperidyl group, a 5,5-dimethyl-2,4-dioxo-3-oxazolidinyl group, a 1-benzyl-ethoxy-3-hydantoinyl group, a 2N-1,1,-dioxo-3(2H)-oxo-1,2-benzoisothiazolyl group, a 2-oxo-1,2-dihydro-1-pyridinyl group, an imidazolyl group, a pyrazolyl group, a 3,5-diethyl-1,2,4-triazol-1-yl group, a 5- or 6-bromo-benzotriazol-1-yl group, a 5-methyl-1,2,3,4-triazol-1-yl group, a benzimidazolyl group, a 3-benzyl-1-hydantoinyl group, a 1-benzyl-5-hexadecyloxy-3-hydantoinyl group, or a 5-methyl-1-tetrazolyl group), an arylazo group (such as a 4-methoxyphenylazo group, a 4-pivaloylaminophenylazo group, a 2-naphthylazo group or a 3-methyl-4-hydroxyphenylazo group) or a group to be bonded via a sulfur atom (such as a phenylthio group, a 2-carboxyphenylthio group, a 2-methoxy-5-t-octylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group or a 2-phenyl-3-dodecyl-1,2,4-triazolyl-5-thio group).

In the couplers of the formula (II), $R^{12}$ and $R^{13}$ may be bound to each other to form a 5- to 7-membered ring.

Where $R^{11}$, $R^{12}$, $R^{13}$ or X represents a divalent group to form a bis-type coupler, $R^{11}$, $R^{12}$ and $R^{13}$ preferably each represents a substituted or unsubstituted alkylene group (such as a methylene group, an ethylene group, a 1,10-decylene group or a $—CH_2CH_2—O—CH_2CH_2—$ group), a substituted or unsubstituted phenylene group (such as a 1,4-phenylene group, a 1,3-phenylene group,

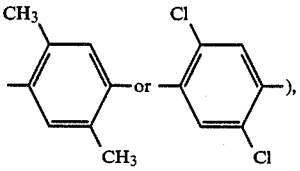

an $—NHCO—R^{14}—CONH—$ group (wherein $R^{14}$ represents a substituted or unsubstituted alkylene or phenylene group, such as $—NHCOCH_2CH_2CONH—$,

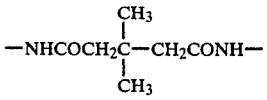

or

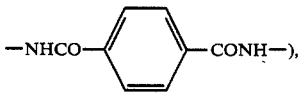

or $—S—R^{14}—S—$ group (wherein $R^{14}$ represents a substituted or unsubstituted alkylene group, such as $—S—CH_2CH_2—S—$ or

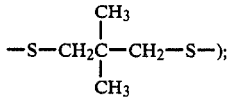

and X represents a group corresponding to the above-mentioned groups, in which pertinent positions are made divalent.

Where the basic structural elements of the formulae (II), (III), (IV), (V) and (VI) are contained in vinyl monomers, the binding group represented by $R^{11}$, $R^{12}$, $R^{13}$ or X comprises a combination of groups selected from a substituted or unsubstituted alkylene group (such as a methylene group, an ethylene group, a 1,10-decylene group or $—CH_2CH_2OCH_2CH_2—$), a substituted or unsubstituted phenylene group (such as a 1,4-phenylene group, a 1,3-phenylene group,

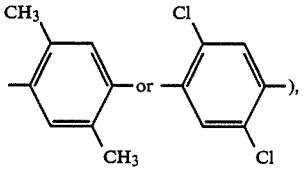

—NHCO—, —CONH—, —O—, —OCO— and an aralkylene group (such as

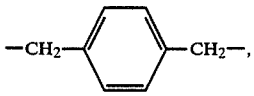

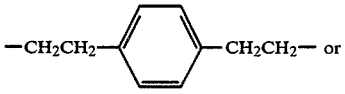

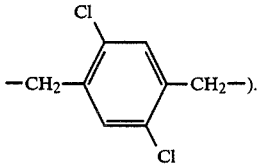

Preferred binding groups represented by $R^{11}$, $R^{12}$, $R^{13}$ or X are as follows:

—NHCO—, $—CH_2CH_2—$.

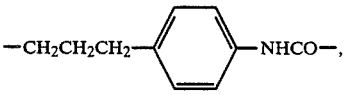

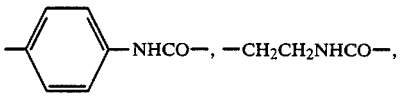

$—CH_2CH_2—O—\underset{\underset{O}{\|}}{C}—$, $—CONH—CH_2CH_2NHCO—$,

-continued $-CH_2CH_2O-CH_2CH_2-NHCO-$ and

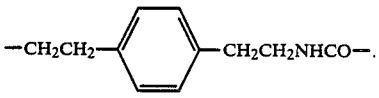

The vinyl group in the vinyl monomers may have any other substituents than the groups of the formulae (I), (II), (III), (IV), (V) and (VI); preferred substituents therefor are a chlorine atom or a lower alkyl group having 1–4 carbon atoms (such as a methyl group or an ethyl group).

The monomers containing the group represented by the formulae (II), (III), (IV), (V) and (VI) may form copolymers together with non-coloring ethylenic monomers which do not undergo a coupling reaction with an oxidation product of an aromatic primary amine developing agent.

The non-coloring ethylenic monomers which do not undergo a coupling reaction with an oxidation product of an aromatic primary amine developing agent include acrylic acid, α-chloroacrylic acid, α-alkylacrylic acids (such as methacrylic acid) and esters or amides derived from these acrylic acids (such as acrylamide, n-butylacrylamide, t-butylacrylamide, diacetonacrylamide, methacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxy ethyl methacrylate, methylene-dibisacrylamide, vinyl esters (such as vinyl acetate, vinyl propionate and vinyl laurate), acrylonitrile, methacrylonitrile, aromatic vinyl compounds (such as styrene and derivatives thereof, vinyl-toluene, divinylbenzene, vinyl-acetophenone and sulfostyrene), itaconic acid, citraconic acid, crotonic acid, vinylidene chloride, vinylalkylethers (such as vinylethylether), maleic acid, maleic anhydride, maleates, N-vinyl-2-pyrrolidone, N-vinylpyridine, and 2- and 4-vinylpyridines. These non-coloring ethylenic unsaturated monomers may be used in the present invention in the form of a mixture of two or more of them. For instance, combinations of n-butyl acrylate and methyl acrylate, styene and methacrylic acid, methacrylic acid and acrylamide or methyl acrylate and diacetonacrylamide may be used.

As is well known in the field of polymer-color couplers, the non-coloring ethylenic unsaturated monomers to be copolymerized with solid water-insoluble monomer couplers can be selected so that the physical properties and/or chemical properties of the copolymers to be formed, such as solubility, compatibility with a binder of photographic colloid compositions (e.g., gelatin), flexibility and thermal stability, are influenced in a favorable manner by the selected monomers.

The polymer couplers to be used in the present invention may be either water-soluble or water-insoluble, and in particular, polymer-coupler latexes are preferred.

Concrete examples of the pyrazoloazole-type magenta couplers of the formula (I) to be used in the present invention and the method for the synthesis of these couplers are described in Japanese Patent Application (OPI) Nos. 162548/84, 171956/84 and 33552/85; Japanese Patent Application No. 27745/84; and U.S. Pat. No. 3,061,432.

Typical pyrazoloazole-type magenta couplers which may be used in the present invention and examples of vinyl monomers which may comprise the polymer couplers described above are set forth below, which, however, do not restrict the scope of the present invention whatsoever.

(M-1)

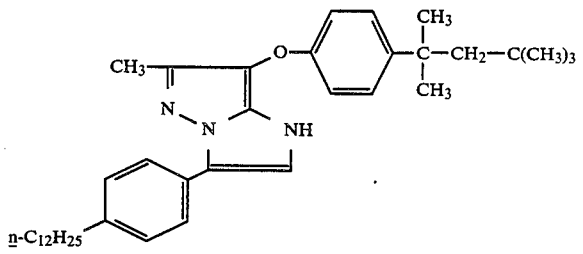

(M-2)

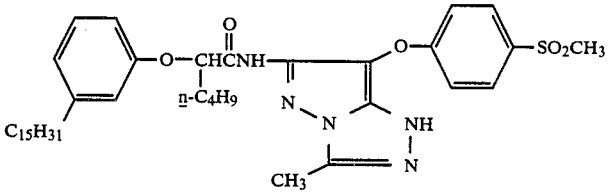

(M-3)

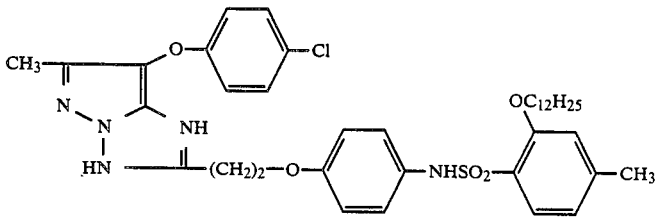

-continued
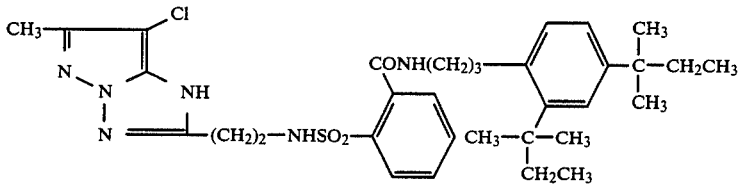
(M-4)
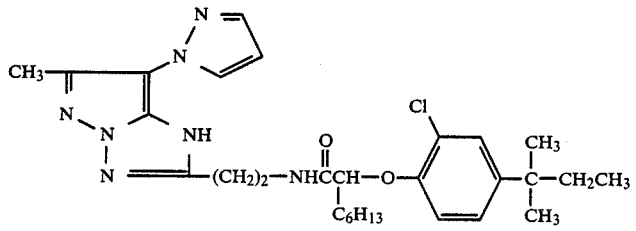
(M-5)
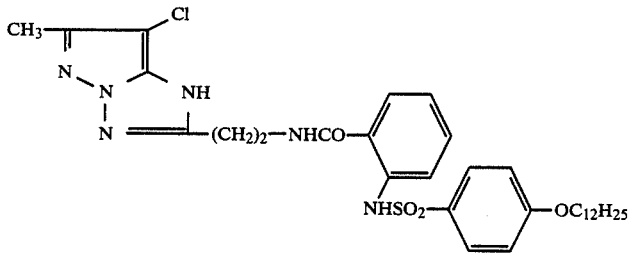
(M-6)
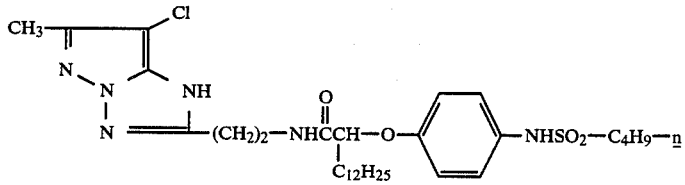
(M-7)
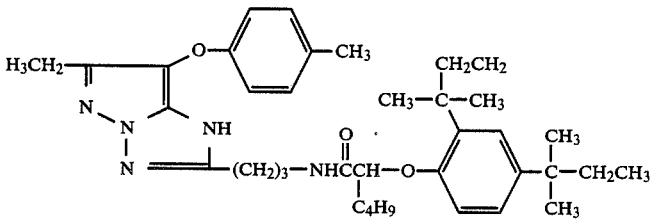
(M-8)
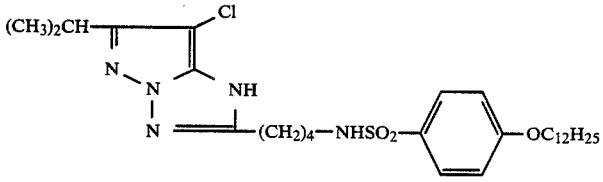
(M-9)
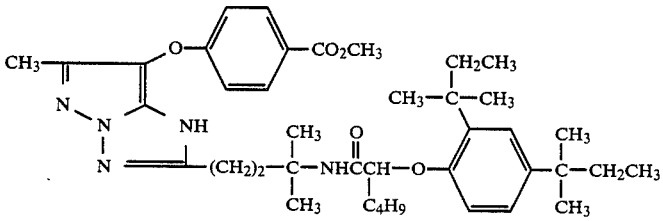
(M-10)

-continued
(M-11)
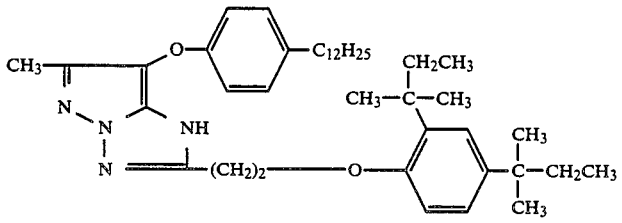
(M-12)
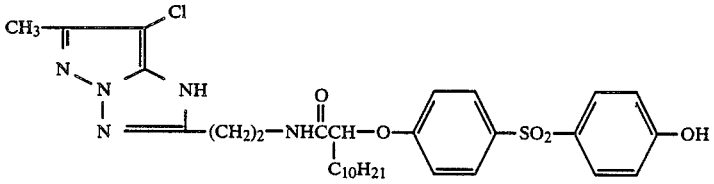
(M-13)
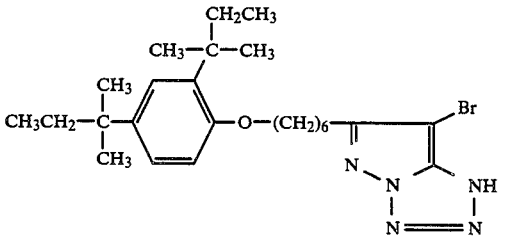
(M-14)
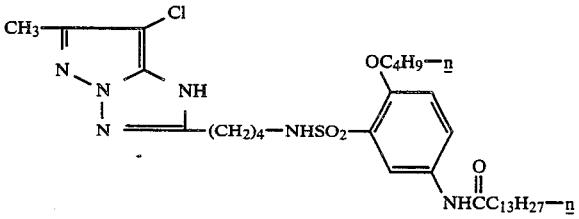
(M-15)
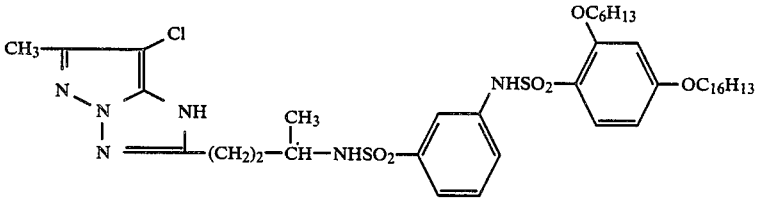
(M-16)
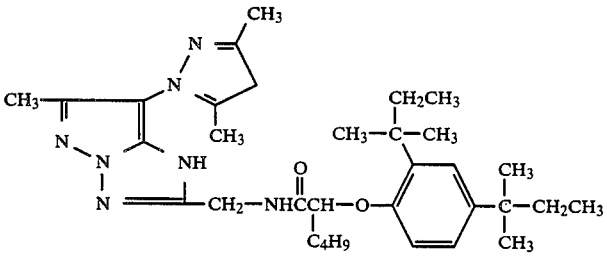
(M-17)
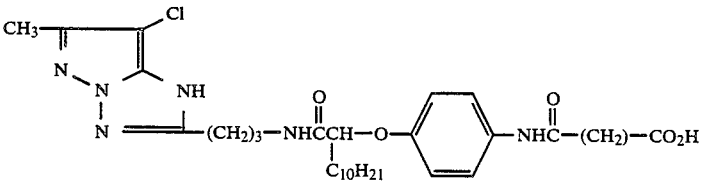

-continued
(M-18)
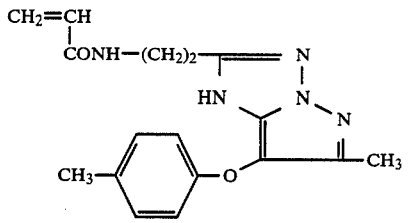
(M-19)
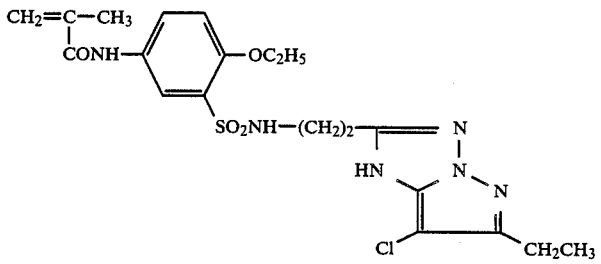
(M-20)
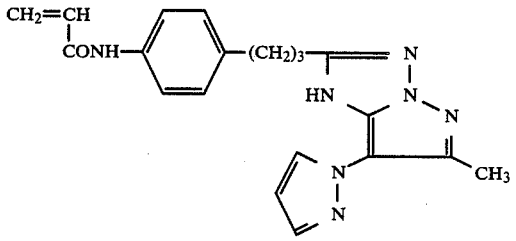
(M-21)
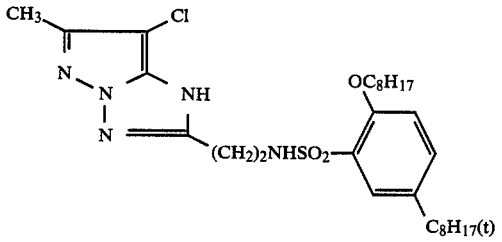
(M-22)
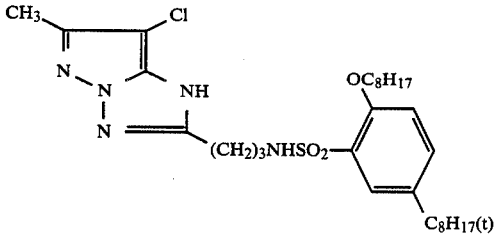
(M-23)
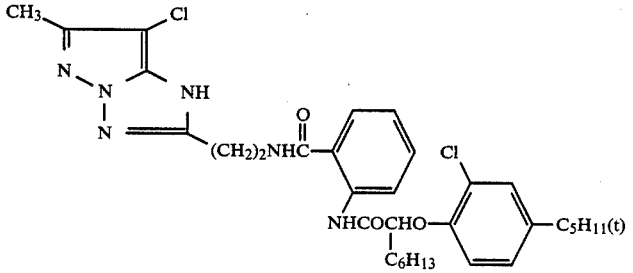

-continued
(M-24)
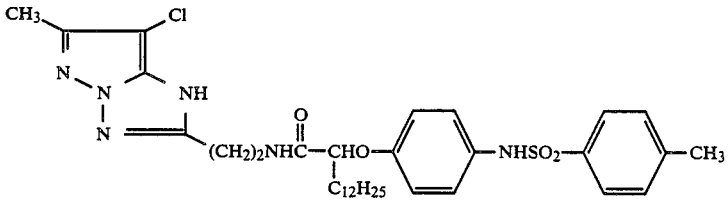
(M-25)
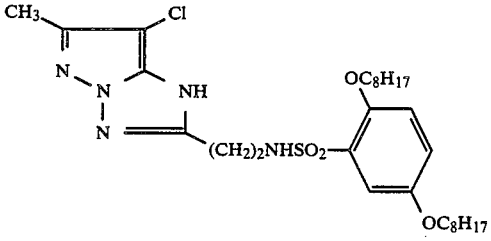
(M-26)
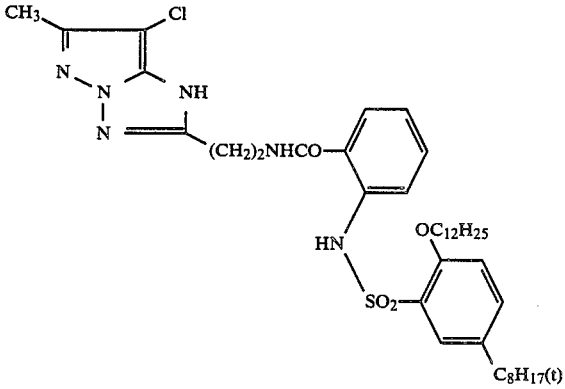
(M-27)
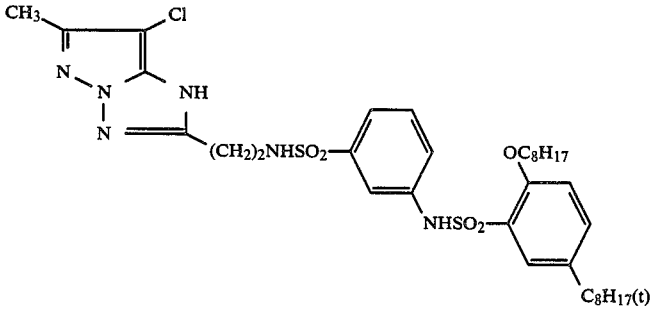
(M-28)
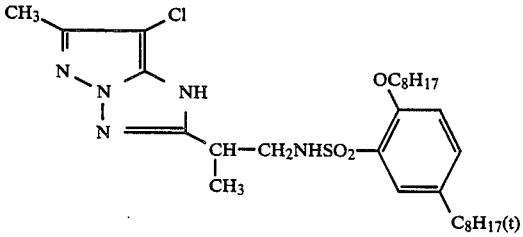
(M-29)
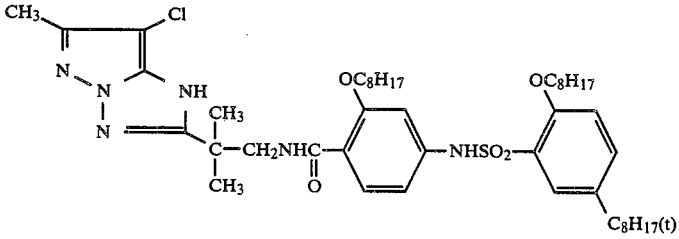

-continued
(M-30)
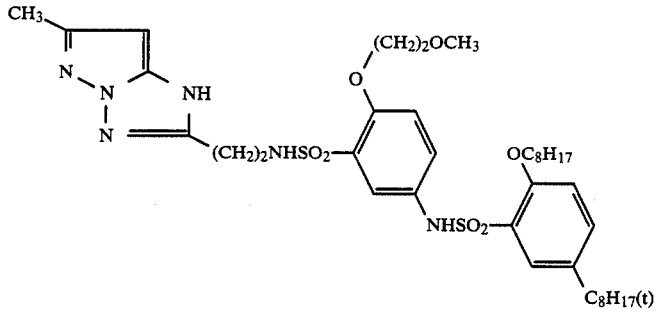
(M-31)
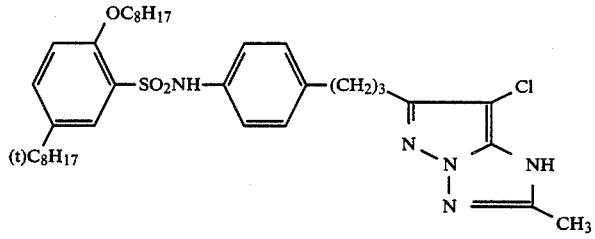
(M-32)
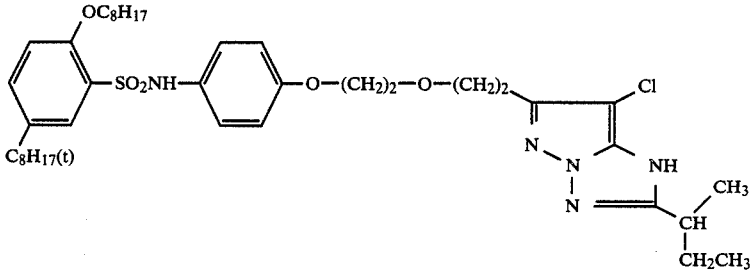
(M-33)
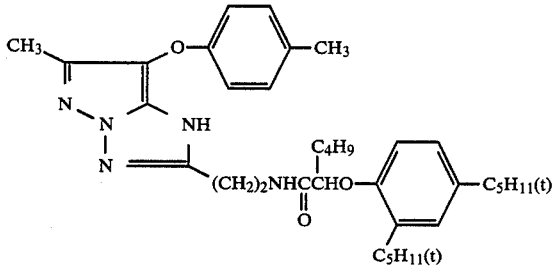
(M-34)
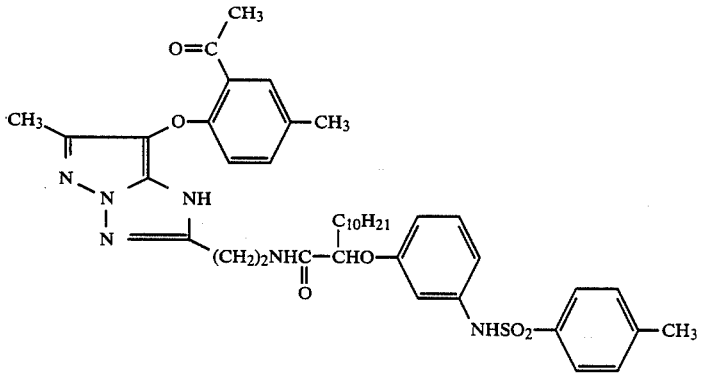

-continued
(M-35)
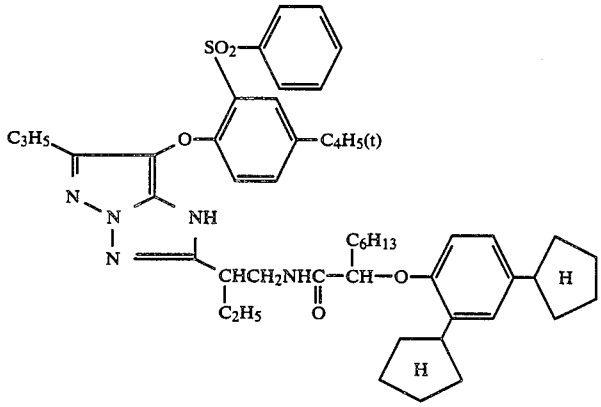
(M-36)
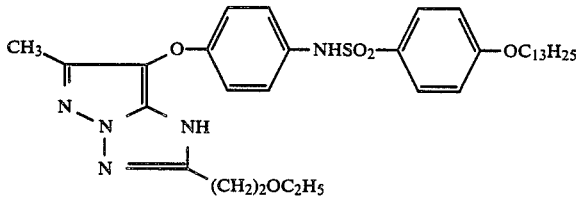
(M-37)
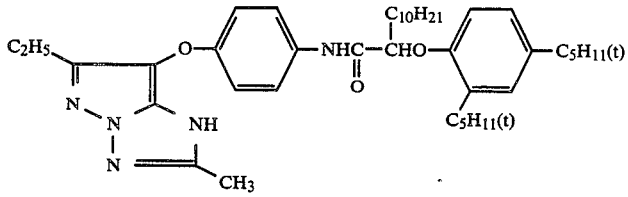
(M-38)
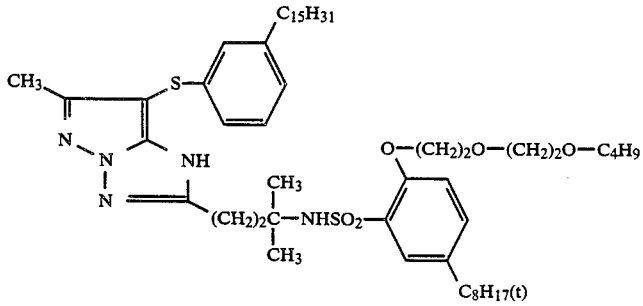
(M-39)
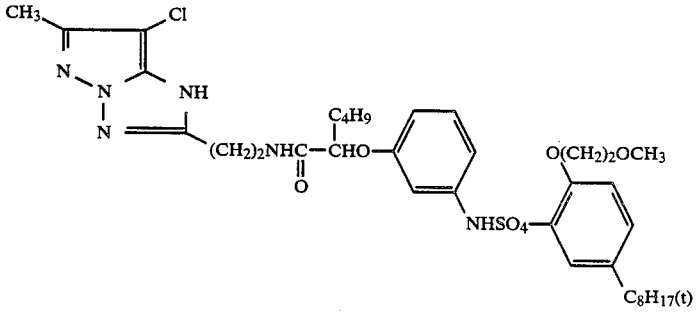

-continued
(M-40)
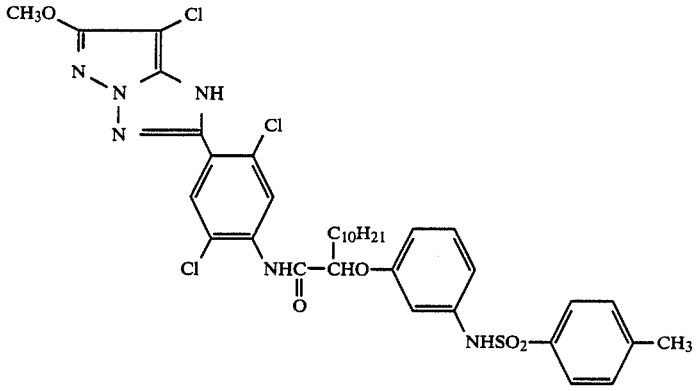
(M-41)
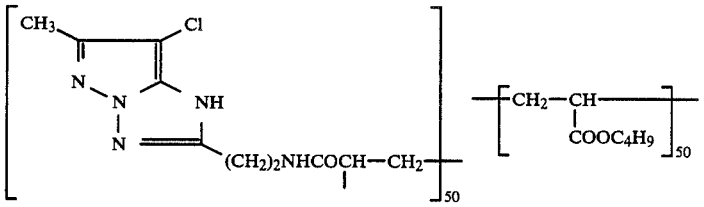
(M-42)
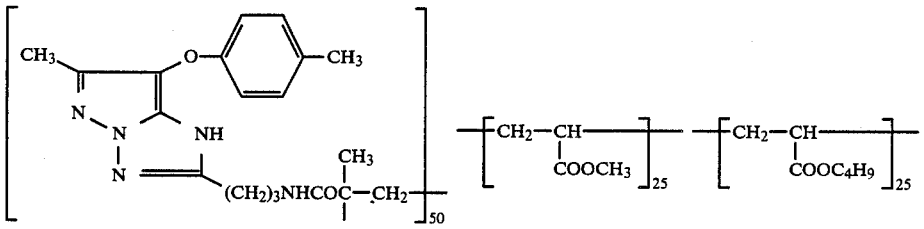
(M-43)
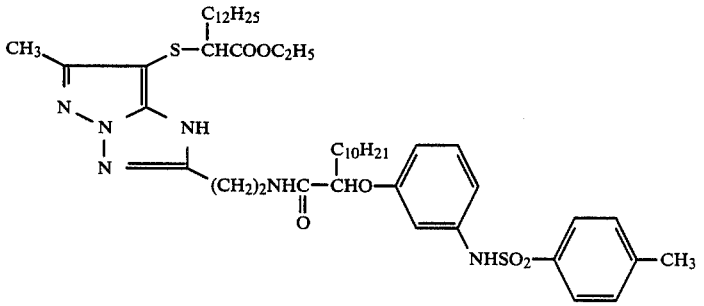
(M-44)
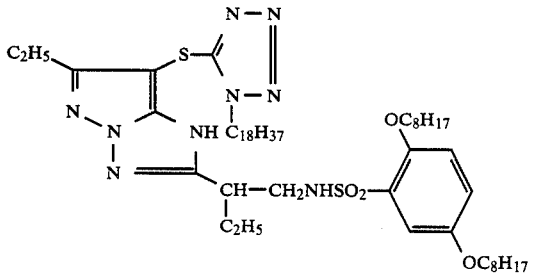

-continued
(M-45)
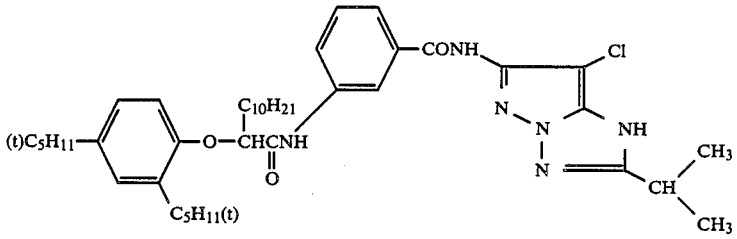
(M-46)
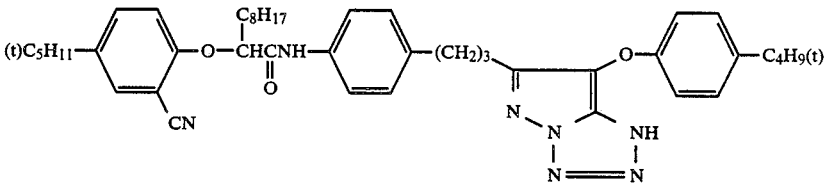
(M-47)
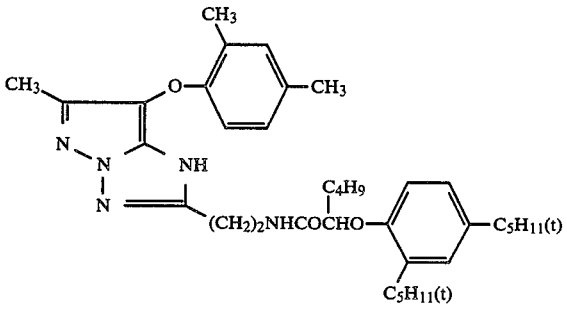
(M-48)
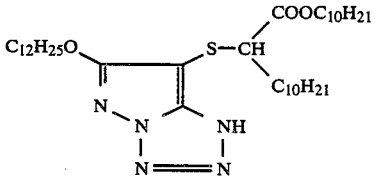
(M-49)
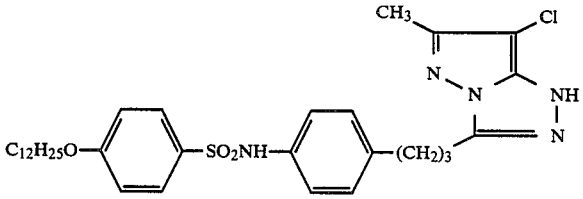
(M-50)
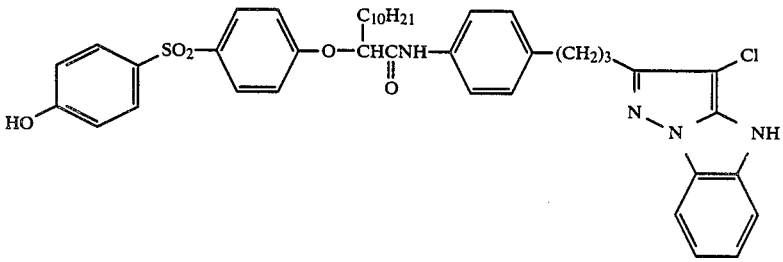

-continued
(M-51)
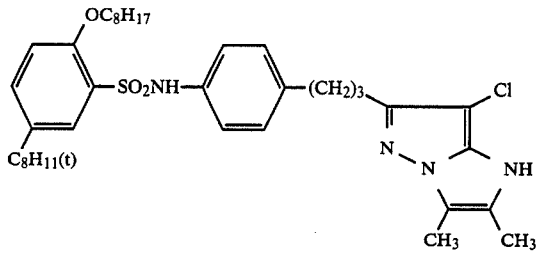
(M-52)
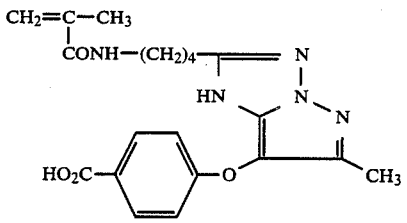
(M-53)
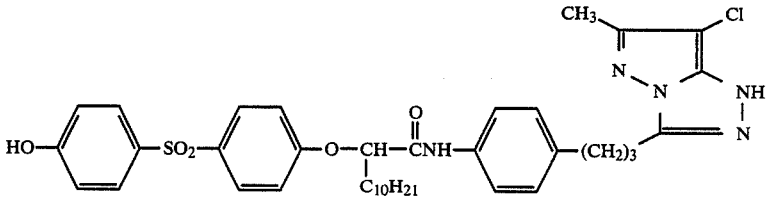
(M-54)
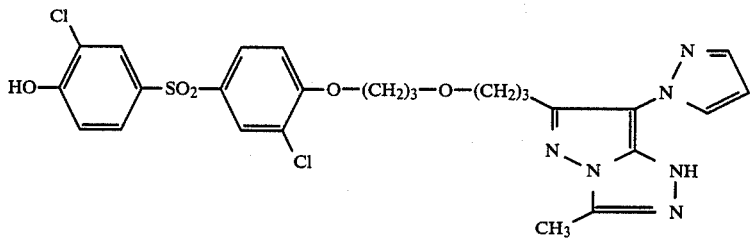
(M-55)
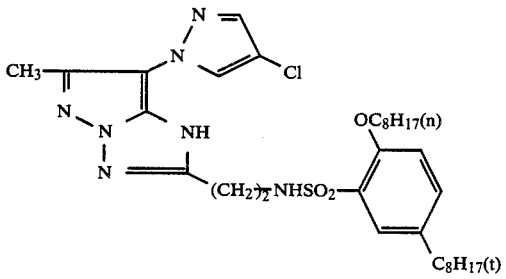
(M-56)
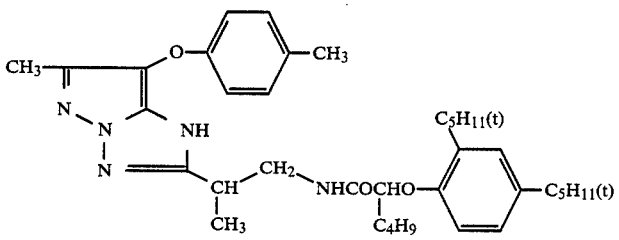

-continued (M-57)

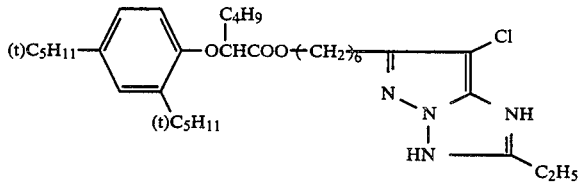

(M-58)

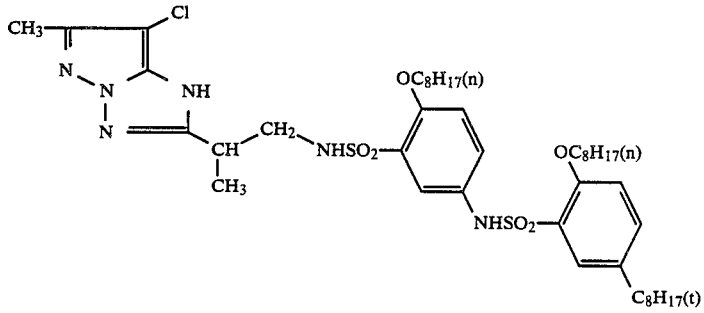

In the actual practice of the present invention, couplers capable of forming colored dyes having the necessary diffusiveness, non-coloring couplers or DIR couplers capable of releasing a development-inhibitor or couplers capable of releasing a development-accelerator in the coupling reaction may also be used. In addition, a yellow coupler and/or a cyan coupler is/are preferably used at the same time in order to obtain a multi-color image.

Typical examples of yellow couplers which may be used in the present invention are oil-protected acylacetamide-type couplers. Examples thereof are described in U.S. Pat. Nos. 2,407,210, 2,875,057 and 3,265,506. In the present invention, divalent yellow couplers are preferably used; typical examples thereof are oxygen atom-releasing yellow couplers as described in U.S. Pat. Nos. 3,408,194, 3,447,928, 3,933,501 and 4,022,620; nitrogen atom-releasing yellow couplers are described in Japanese Patent Publication No. 10739/83, U.S. Pat. Nos. 4,401,752 and 4,329,024, *Research Disclosure* No. 18053 (April, 1979), British Pat. No. 1,425,020, and West German Patent Application (OPI) Nos. 2,219,917, 2,261,361, 2,329,587 and 2,433,812. α-pivaloylacetanilide-type couplers are excellent with respect to fastness, especially light-fastness, of the formed color dyes; and on the other hand, α-benzoylacetanilide-type couplers may form color dyes of high color density.

Cyan couplers which may be used in the present invention include oil-protected naphthol-type or phenol-type couplers. Examples of naphthol-type couplers are described in U.S. Pat. No. 2,474,293. These couplers are particularly preferred. Typeical example of the preferred cyan couplers are oxygen atom-releasing-type di-equivalent naphthol-type couplers as described in U.S. Pat. Nos. 4,052,212, 4,146,396, 4,228,233 and 4,296,200. Examples of phenol-type couplers are described in U.S. Pat. Nos. 2,369,929, 2,801,171, 2,772,162 and 2,895,826. Such cyan couplers that are fast to moisture and temperature are preferably used in that present invention, and typical examples thereof are phenol-type cyan couplers having an ethyl or a higher alkyl group in the m-position of the phenol nucleus, as described in U.S. Pat. No. 3,772,002; 2,5-diacylamino-substituted phenyl-type couplers as described in U.S. Pat. Nos. 2,772,162, 3,758,308, 4,126,396, 4,334,011 and 4,327,173, West German Patent Application (OPI) No. 3,329,729 and Japanese Patent Application No. 42671/83; and phenol-type couplers having a 2-phenylureido group and a 5-acylamino group, as described in U.S. Pat. Nos. 3,446,622, 4,333,999, 4,451,559 and 4,427,767. Couplers capable of forming colored dyes having the required diffusiveness may be used at the same time. These couplers are described in various publications, for example, examples of magenta couplers are described in U.S. Pat. No. 4,366,237 and British Pat. No. 2,125,570; and examples of yellow, magenta and cyan couplers are described in European Pat. No. 96,570 and West German Patent Application (OPI) No. 3,234,533.

These couplers are incorporated in the photographic materials of the present invention in such manner that the same photo-sensitive layer contains two or more kinds of couplers or otherwise the same coupler may be incorporated in two or more different layers, so as to satisfy the necessary characteristics of the photographic materials.

The couplers to be used in the photographic materials of the present invention may be incorporated therein by means of various known dispersing methods, and typical examples of these dispersing methods are solid-dispersion and alkali-dispersion. More preferred is latex-dispersion, and most preferably oil-in-water dispersion. In the oil-in-water dispersion method, the coupler is first dissolved in a single solvent selected from high boiling point organic solvents having a boiling point of 175° C. or higher and so-called auxiliary solvents of a low boiling point (e.g., about 150° C. or less). Alternatively, the coupler may be dissolved in a mixture of these high and low boiling point solvents, and then the resulting solution is finely dispersed in an aqueous medium such as water or a gelatin-aqueous solution in the presence of a surfactant. Examples of high boiling point organic solvents are described, for example, in U.S. Pat. No. 2,322,027.

The standard amount of the color couplers to be used is within the range of from about 0.001 mole to about 1 mole, and preferably, the amount of the yellow coupler to be used is 0.01–0.5 mole, that of the magenta coupler is 0.003–0.3 mole and that of the cyan coupler is 0.002–0.3 mole.

The photographic materials of the present invention may contain, as a color-fog inhibitor or color-stain inhibitor, a hydroquinone derivative, an aminophenol derivative, an amine compound, a gallic acid derivative, a catechol derivative, an ascorbic acid derivative, a non-coloring coupler and a sulfonamidophenol derivative.

Various kinds of color-deterioration inhibitors may also be incorporated in the photographic materials of the present invention. Typical organic color-deterioration inhibitors are hydroquinones, 6-hydroxychromans, 5-hydroxycoumarans, spirochromans, p-alkoxyphenols, bisphenols as well as hindered phenols, gallic acid derivatives, methylenedioxybenzenes, aminophenols, hindered amines and ether or ester derivatives thereof obtained by silylating or alkylating the phenolic hydroxyl group therein. In addition, metal complexes such as (bis-salicylaldoximato)nickel complex and (bis-N,N-dialkyldithiocarbamato)nickel complex may also be used.

Compounds having both partial structures of hindered amines and hindered phenols in the same molecule, as described in U.S. Pat. No. 4,268,593, are especially effective for the prevention of the deterioration of the formed yellow images due to heat, humidity and light. In addition, spiroindanes as described in Japanese Patent Application (OPI) No. 159644/81 and hydroquinone-dietheror -monoether-substituted chroman derivatives as described in Japanese Patent Application (OPI) No. 89835/80 are preferably used for preventing deterioration of the formed magenta color image, especially for the prevention of light-deterioration thereof.

The photographic materials of the present invention may further contain an ultra-violet absorbent in the hydrophilic colloid layer thereof.

The photographic materials of the present invention may also further contain a water-soluble dye in the hydrophilic colloid layer thereof, either as a filter dye or for the purpose of preventing irradiation or halation or for other various purposes.

The photographic materials of the present invention may contain stilbene-type, triazine-type, oxazole-type or coumarin-type whitening agent in the photo-sensitive emulsion layer or any other hydrophilic colloid layer thereof. For example, water-soluble whitening agents may be used, alternatively, water-insoluble whitening agents may be used in the form of a dispersion.

Gelatin is preferred as the binder or protective colloid to be used in the emulsion layer or intermediate layer of the photographic materials of the present invention. It is known that other hydrophilic colloids may also be used as the binder.

Conventional lime-treated gelatine, as well as acid-treated gelatins or enzyme-treated gelatins, and hydrolyzed products or enzyme-decomposed products of gelatin may be used as the gelatin.

The photographic materials of the present invention may further contain an inorganic or organic hardener in any desired hydrophilic colloid layer which constitutes the photo-sensitive layer or a backing layer thereof.

The photographic materials of the present invention may contain one or more surfactants for various purposes such as coating assistance, static charge prevention, improvement of sliding properties, emulsification and dispersion, anti-blocking and improvement of photographic characteristics (such as development acceleration, intensification of high contrast and sensitization).

In addition to the above-mentioned additives, the photographic materials of the present invention may further contain various kinds of stabilizers, stain-inhibitors, developers and precursors thereof, development-accelerators and precursors thereof, lubricant agents, mordant agents, matting agents, anti-static agents, plasticizers or other various kinds of additives which are useful in photographic materials. Typical examples of these additives are described in *Research Disclosure* No. 17643 (December, 1978) and No. 18716 (November, 1979).

The present invention may be adapted to multi-layer and multi-color photographic materials which have at least two photo-sensitive layers of different spectral sensitization on a support. Natural color multi-layer photographic materials have, in general, at least one red-sensitive emulsion layer, at least one green-sensitive emulsion layer and at least one blue-sensitive emulsion layer on a support. The order of these layers to be provided on the support may freely be selected, in accordance with the use and the object of the photographic materials. Each of these emulsion layers may comprise two or more layers each having a different sensitivity, or in some cases, two or more emulsion layers having the same color-sensitivity may be interrupted by a non-photosensitive layer existing therebetween.

The photographic materials of the present invention preferably have, in addition to the silver halide emulsion layers, a protective layer, an intermediate layer, a filter layer, an anti-halation layer, a backing layer or similar auxiliary layers, if desired.

The photographic emulsion layers and other layers as mentioned above are coated on a support which is generally used in conventional photographic materials, such as a flexible support (e.g., plastic film, paper or cloth) or a rigid support (e.g., glass, earthen ware, or metal), to obtain the photographic materials of the present invention.

The present invention may be adapted to general silver halide color photographic materials such as color papers, color positive films, color negative films, color reversal films for slides, color reversal films for movies and color reversal films for TV. In particular, the present invention is preferably adapted to color papers which are required to have excellent color-reproducibility, excellent color image-fastness and a high degree of stability during development when so used a remarkable effect can be attained.

The color developer to be used in the development treatment of the photographic materials of the present invention is preferably an alkaline aqueous solution essentially comprising an aromatic primary amine-type developing agent. P-phenylenediamine-type compounds are preferably used as the color developing agent, and typical examples thereof are 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline and sulfates thereof, hydrochloride or p-toluenesulfonates thereof.

The color developer generally contains a pH buffer such as alkali metal carbonates, borates or phosphates or a development-inhibitor or an anti-fogging agent such as bromides, iodides, benzimidazoles, benzothizoles or mercapto compounds.

The photographic emulsion layer is generally bleached after the color development. The bleaching treatment may be carried out simultaneously with a fixation treatment or may be carried out separately therefrom. As the bleaching agent, polyvalent metal compounds such as iron(III)-, cobalt (III)-, chromium(-VI)- or copper(II)-compounds as well as peracids, quinones and nitroso compounds may be used. Typical bleaching agents which may be used in the present invention are ferricyanides; bichromates; iron(III)- or cobalt(III)-organic complexes (for example, complexes with an aminopolycarboxylic acid such as ethylenediaminetetraacetic acid, diethylenetriamine-pentaacetic acid, nitrilo-triacetic acid or 1,3-diamino-2-propanoltetraacetic acid, or other organic acids such as citric acid, tartaric acid or malic acid), persulfates; manganates; and nitrosophenols, Among these, iron(III)/ethylenediaminetetraacetate complex and persulfates are especially preferred in view of the desirability of rapid treatment and the elimination of environmental contamination. In addition, iron(III)/ethylenediaminetetraacetic complex is particularly preferably used io an independent bleaching solution or in a combined bleaching and fixing solution.

The bleaching solution or the bleaching-fixing solution may contain, if necessary, various kinds of accelerators, for example, compounds as described in U.S. Pat. No. 4,285,984, G. Schwarzenbach et al., *Helv, Chim, Acta.*, 38, 1147 (1955), R. O. Clinton et al., *J. Am. Chem. Soc.*, 70, 950 (1948), Japanese Patent Application (OPI) Nos. 95630/78, 52534/79, 68568/76, 70763/76, 50169/78, 94927/78 and 214855/84, and Japanese Patent Publication No. 9854/78.

After the bleaching-fixing treatment or the fixing treatment, a washing step is usually carried out. In the washing step, various kinds of known compounds may be added to the treating solution, for the purpose of preventing sedimentation or economizing the amount of water to be used. For example, various kinds of additives may be added for the purpose of prevention of sedimentation, including a water-softener (such as inorganic phosphoric acids, aminopolycarboxylic acids or organic phosphoric acids), a germicide or an antifungal agent for the purpose of preventing growth of various bacteria algae or molds, or a hardener (such as magnesium salts or aluminium salts, etc.). In particular, a water-softener (such as inorganic phosphoric acids, aminopolycarboxylic acids, organic phosphoric acids, aminopolyphosphonic acids, phosphonocarboxylic acids), a germicide (such as benzoisothiazolinones, isothiazolones, 4-thiazolinebenzimidazoles, or halogenated phenols), a surfactant, a fluorescent whitening agent, a hardener or similar various kinds of additives are preferably used, and these may be used singly or as a mixture of two or more different additives.

As the membrane-pH regulating agent which is preferably added to the treating solution after treatment, various kinds of ammonium salts such as ammonium chloride, ammonium nitrate, ammonium sulfate, ammonium phosphate, ammonium sulfite or ammonium thiosulfate may be used.

The silver halide color photographic materials of the present invention may contain a color developing agent for simplifying and quickening the processing. For using the color developing agent in the color photographic materials, the various precursors for color developing agent are preferably used.

The silver halide color photographic materials of the present invention may contain, if desired, various kinds of 1-phenyl-3-pyrazolidones, for the purpose of accelerating color development.

The treating solutions are used at a temperature of from about 10° C. to about 50° C. in the practice of the present invention. In particular, the temperature range of from 33° C. to 38° C. is standard for the treatment of the materials of the present invention, and in some cases, it is possible to elevate the treating temperature even higher so as to accelerate the treatment and thus reduce the treating time, or conversely, it is also possible to lower the treating temperature so as to improve the quality of images obtained or to improve the stability of the treating solution. In addition, a treatment with cobalt-intensification or hydrogen peroxide-intensification, as described in German Pat. No. 2,226,770 and U.S. Pat. No. 3,674,499, may be carried out for the purpose of economization of silver to be used.

The treating baths may optionally be provided with a heater, a temperature sensor, a liquid-surface sensor, a circulating pump, a filter, a floating lid plate and a squeezer, if desired.

The present invention will be explained in greater detail by reference to the following examples, which, however, are not intended to be interpreted as limiting the scope of the present invention in any manner.

PREPARATION OF EMULSIONS

Emulsions (A) through (D) as used in the following Example 1 were prepared as follows:

Emulsion (A):

Tabular grains were prepared in accordance with the method as described in Japanese Patent Application (OPI) No. 111936/83 (corresponding to U.S. Pat. No. 4,414,306).

24.2 g of NaCl and 1.1 g of KBr were added to 900 cc of 3%-gelatin aqueous solution, while kept at 55° C. and stirred under rotation of 600 rpm, and 22.5 cc of 17%-$AgNO_3$ aqueous solution (corresponding to 3.8% of the amount of total $AgNO_3$) and a halogen-solution containing 10%-KBr and 3.7%-NaCl were added thereto by a double-jet method, while the initial pAg value was kept constant by appropriately regulating the amount of the KBr solution as added.

Next, 566.4 cc of $AgNO_3$ aqueous solution of the same concentration as the above first step (corresponding to 96.2% of the amount of total $AgNO_3$) and the same halogen solution as above were added to the reaction solution in the course of 64 minutes, while accelerated by a double-jet method. During this addition, the amount of $AgNO_3$ solultion was increasingly added so that the amount of this solution as added per one minute (v cc/min.) satisfied a formula of ($v=4.4+0.138\ t$) (in which t means the time for the addition of the solution, and this t is 0 at the beginning of the second step, the unit of t being measured in minutes), and the halogen solution was so added that the initial pAg value in the reaction solution was kept constant. After the soluble salts were removed by the sedimentation method, gelatin was added and the contents were again dispersed therein, and thereafter 6 mg of sodium thiosulfate per 1 mole of Ag was added to the resulting dispersion and ripened for 50 minutes at 50° C. for chemical sensitization.

The thus-obtained emulsion contained tabular grains in an amount of 85% of the total projected area of all the silver halide grains therein, and the average thickness of the tabular grains was 0.13 μm, and the average aspect ratio thereof was 7.

The average grain size of the thus-obtained emulsion (A) was 0.67 μm (as measured with a Coal Tar Counter TA-II manufactured by Coal Tar Electronics Co.), and the content of AgBr was 85 mole% with the remaining content comprising AgCl.

Emulsion (B):

Emulsion (B) was prepared in the same manner as the preparation of the Emulsion (A) with the exceptions that the amount of KBr to be added to the gelatin-aqueous solution was varied to 0.5 g in order to elevate the pAg value of the reaction solution and the addition time was 10 minutes. Thus, Emulsion (B) was obtained.

The Emulsion (B) contained tabular silver halide grains in an amount of 85% of the total projected area of all the grains therein, and the average thickness of the tabular grains was 0.15 μm and the average aspect ratio thereof was 7. The average grain size of the Emulsion (B) was 0.70 μm and the content of AgBr thereof was 65 mole%, the remaining content comprising AgCl.

Comparative Emulsion (C):

A silver bromochloride emulsion having block-like grains was prepared as a comparative emulsion, as follows:

5 g of NaCl was added to 900 cc of 3%-gelatin aqueous solution, while warmed at 65° C. and stirred under rotation of 600 rpm, and 589 cc of 17%-$AgNO_3$ aqueous solution (corresponding to 10% of the amount of total $AgNO_3$) and the same amount of a halogen solution containing 10%-KBr and 5%-NaCl were added thereto over the course of 60 minutes, by a double-jet method. Afterwards, the resulting emulsion was subjected to chemical-sensitization in the same manner as the Emulsion (A), to obtain an Emulsion (C).

The Emulsion (C) contained block-like grains (average aspect ratio: 1.7), and the average grain size thereof was 0.65 μm and the content of AgBr was 85 mole%, the remaining content comprising AgCl.

Comparative Emulsion (D):

An Emulsion (D) comprising a different halogen composition was prepared as a comparative emulsion, as follows:

Emulsion (D) was prepared in the same manner as the preparation of the Emulsion (C) with the exceptions that the composition of the halogen solution comprised 7.6% of KBr and 6% of NaCl and the addition time of the $AgNO_3$-aqueous solution and the halogen solution was 70 minutes.

The Emulsion (D) contained block-like grains (average aspect ratio: 1.7), and the average grain size thereof was 0.65 μm and the content of AgBr was 65 mole%, the remaining content comprising AgCl.

MAGENTA COUPLERS

The above-listed magenta couplers Nos. (M-55) through (M-58) were used as the pyrazoloazole coupler in the following Example 1.

As comparative couplers, the following couplers (E) and (F) were used.

Comparative Coupler (E):

-continued

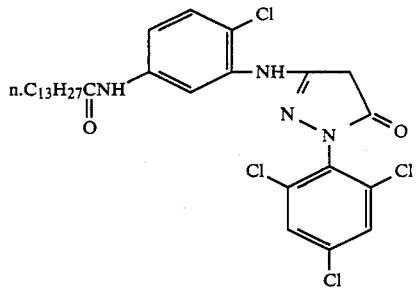

Comparative Coupler (F):

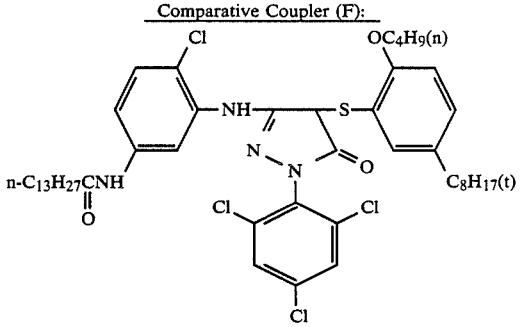

Each of the above couplers (M-55) through (M-58) and comparative couplers (E) and (F) was dissolved in a mixture solution comprising trioctyl phosphate and ethyl acetate, together with the following color-deterioration inhibitors (G) and (H), under heat, and the resulting solution was emulsified and dispersed in 10-gelatin aqueous solution containing 1%-sodium dodecylbenzenesulfonate, to obtain a magenta-emulsion.

Color-Deterioration Inhibitor (G):

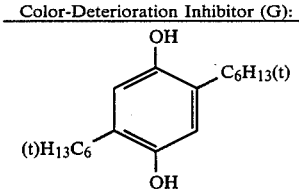

Color-Deterioration Inhibitior (H):

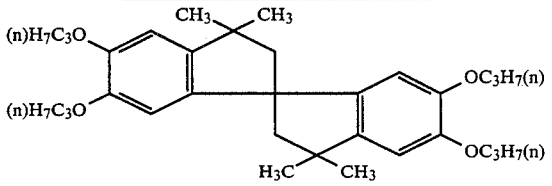

DEVELOPMENT TREATMENT

The step for the development of the silver halide color photographic materials of the following Example 1 and the treating solutions therefor are explained below.

Treatment (A):

| Treatment step | Temperature | Time |
|---|---|---|
| Development | 33° C. | 3.5 min. |
| Bleaching-fixation | 33° C. | 1.5 min. |
| Washing with water | 28–35° C. | 3.0 min. |

Developer:

-continued

| | |
|---|---|
| 3Na—nitrilotriacetate | 2.0 g |
| Benzyl alcohol | 15 ml |
| Diethyleneglycol | 10 ml |
| $Na_2SO_3$ | 2.0 g |
| KBr | 0.5 g |
| Hydroxylamine sulfate | 3.0 g |
| 4-amino-3-methyl-N—ethyl-N—[β-(methanesulfonamido)ethyl]-p-phenylenediamine sulfate | 5.0 g |
| $Na_2CO_3$ (mono-hydrate) | 30 g |
| Water to make | 1 liter (pH 10.1) |
| Bleaching-fixing solution: | |
| Ammonium thiosulfate (70 wt. %) | 150 ml |
| $Na_2SO_3$ | 15 g |
| $NH_4$ [Fe(EDTA)] | 55 g |
| EDTA.2Na | 4 g |
| Water to make | 1 liter (pH 6.9) |
| (EDTA is ethylenediaminetetraacetic acid) | |

Treatment (B):

The treatment (B) was same as the treatment (A) with the exception that the amount of the sodium sulfite in the developer, which was a treatment variation factor, was varied to 1/10 of the amount in the treatment (A), i.e., 0.2 g.

Treatment (C):

The treatment (C) was same as the treatment (A) with the exception that the amount of the sodium sulfite in the developer, which was a treatment variation factor, was varied to 3.3 times the amount of the treatment (A).

Treatment (D):

Each sample was subjected to continuous treatment by the use of Fuji Color Roll Processor FPRP-115 (manufactured by Fuji Photo Film Co.), according to the following steps.

| Step | Time | Temperature | Tank Capacity |
|---|---|---|---|
| Color development | 3.5 min. | 38° C. ± 0.3° C. | 60 lit. |
| Bleaching fixation | 1.5 min. | 33° C. ± 1° C. | 40 lit. |
| Washing with water (1) | 1 min. | 33° C. ± 3° C. | 20 lit. |
| Washing with water (2) | 1 min. | 33° C. ± 3° C. | 20 lit. |
| Washing with water (3) | 1 min. | 33° C. ± 3° C. | 20 lit. |

The washing was carried out by three-stage counter-current washing from the washing step (1) to the washing step (3).

In the process from the bleaching-fixation step to the water-washing step (3), the amount of the treating solution as transferred from the previous tank to the next tank was 60 ml/m² in each step.

The conditions in the color development step were wholly constant, and the amount of the replenisher was 161 ml per 1 m² of the photographic material to be treated, and the composition of the treating solution as used was as follows:

Composition of treating solution, color developer:

| Components | Tank solution | Replenisher |
|---|---|---|
| Water | 800 ml | 800 ml |
| 3Na—nitriloacetate | 2.0 g | 2.0 g |
| Benzyl alcohol | 14 ml | 18 ml |
| Diethyleneglycol | 10 ml | 10 ml |
| Sodium sulfite | 2.0 g | 2.5 g |
| Hydroxylamine sulfate | 3.0 g | 3.5 g |
| Potassium bromide | 1.0 g | — |
| Sodium carbonate | 30 g | 35 g |
| N—ethyl-N—(β-methanesulfonamidoethyl)-3-methyl-4-aminoaniline sulfate | 5.0 g | 8.0 g |
| Water to make | 1000 ml | 1000 ml |
| pH | 10.15 | 10.65 |

The conditions in the bleaching-fixation step were wholly constant, and the amount of the replenisher was 60 ml per 1 m² of the photographic material to be treated. The composition of the treating solution as used was as follows:

Bleaching-fixing solution:

| Components | Tank solution | Replenisher |
|---|---|---|
| Water | 400 ml | 400 ml |
| Ammounium thiosulfate(70%) | 150 ml | 300 ml |
| Sodium sulfite | 18 g | 36 g |
| Ammonium ethylenediamine-tetraacetate/Fe(III) | 55 g | 110 g |
| Disodium ethylenediamine-tetraacetate | 5 g | 10 g |
| Water to make | 1000 ml | 1000 ml |
| pH | 6.70 | 6.50 |

The conditions in the water-washing step were also wholly constant, and the amount of the replenisher was 250 ml per 1 m² of the photographic material to be treated. The composition of the treating solution was as follows:

Water-washing solution:

| | |
|---|---|
| 1-Hydroxyethylidene-1,1-diphosphonic acid (60%) | 2.0 ml |
| Aluminium sulfate | 1.0 g |
| Sulfanylamide | 0.1 g |
| Water to make | 1 lit. |

pH was adjusted to be 7.0 with aqueous ammonia.

Treatment (E):

The treatment (E) was same as the treatment (D) with the exception that the amount of the replenisher in the color development step was ½ of that in the treatment (D), or 80.5 ml/m².

EXAMPLE 1

A photo-sensitive layer comprising the following first to seventh layers was coated on a paper support having both surfaces of which were laminated with polyethylene, to obtain a color photographic material. The polyethylene as laminated on the surface on which the first layer was coated contained titanium dioxide and a slight amount of ultramarine.

Constitution of photo-sensitive layer:

The numerical data corresponding to the respective components each represents the coated amount as designated by the unit g/m². Regarding the silver halide component, the coated amount is shown in terms of the amount of silver.

First layer (blue-sensitive layer):

| | |
|---|---|
| Silver bromochloride emulsion (silver bromide: 80 mole %) | 0.30 (silver) |
| Yellow coupler (y-1) | 0.70 |
| Coupler solvenr (TNP) | 0.15 |

-continued

| | |
|---|---|
| Gelatin | 1.20 |

Second layer (intermediate layer):

| | |
|---|---|
| Gelatin | 0.90 |
| Di-t-octylhydroquinone | 0.05 |
| Solvent for the above (DBP) | 0.10 |

Third layer (green-sensitive layer);

A combination of the emulsion (A) and an emulsion of the coupler (M-58) was coated to form a green-sensitive layer, in an amount as follows:

| | |
|---|---|
| | 0.25 (silver) |
| Magenta coupler (M-58) | 0.35 |
| Solvent for the above (TOP) | 0.44 |
| Color-deterioration inhibitor (G/H) | 0.05/0.10 |
| Gelatin | 1.00 |

Fourth layer (ultraviolet-absorptive intermediate layer):

| | |
|---|---|
| Ultraviolet absorbent (UV-1/UV-2/UV-3) | 0.06/0.25/0.25 |

-continued

| | |
|---|---|
| Solvent for the above (TNP) | 0.20 |

Fifth layer (red-sensitive layer):

| | |
|---|---|
| Silver bromochloride emulsion (silver bromide: 50 mole %) | 0.20 (silver) |
| Cyan coupler (C-8/C-9) | 0.2/0.2 |
| Coupler solvent (TNP/DBP) | 0.10/0.20 |
| Gelatin | 0.9 |

Sixth layer (ultraviolet-absorptive intermediate layer):

| | |
|---|---|
| Ultraviolet absorbent (UV-1/UV-2/UV-3) | 0.06/0.25/0.25 |
| Solvent for the above (DBP) | 0.20 |
| Gelatin | 0.15 |

Seventh layer (protective layer):

| | |
|---|---|
| Gelatin | 1.5 |

In the above layers, DBP is dibutyl phthalate; TOP is tri(n-octylphosphate); and TNP is tri(n-nonylphosphate).

(y-1)

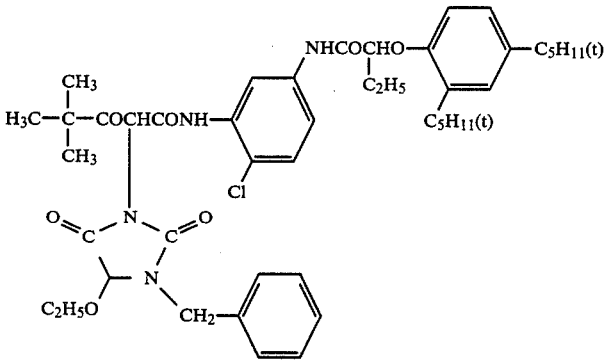

(UV-1)

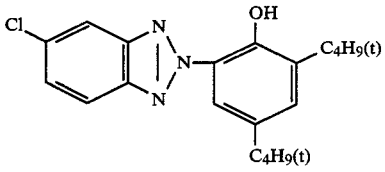

(UV-2)

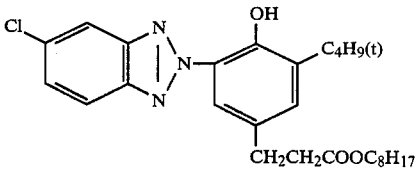

(UV-3)

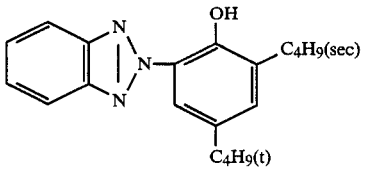

(UV-8)

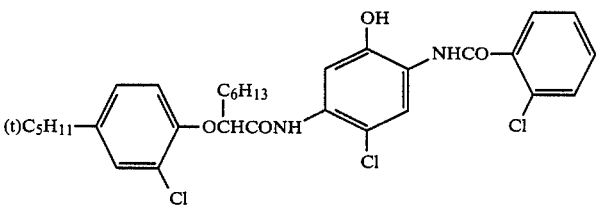

-continued

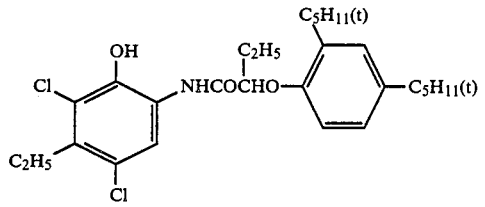

(C-9)

Each emulsion layer contained the following dye as a spectral-sensitizer:

Blue-sensitive emulsion layer:

Triethylammonium 4-{5-chloro-2-[5-chloro-3-(4-sulfonatobutyl)-benzothiazolin-2-ylidenemethyl]-3-benzothiazolio}butanesulfonate ($2\times10^{-4}$ mole per 1 mole of silver halide)

Green-sensitive emulsion layer:

Sodium 3,3'-di-(γ-sulfopropyl)-5,5'-diphenyl-9-ethyloxacarbocyanine ($2.5\times10^{-4}$ mole per 1 mole of silver halide)

Red-sensitive emulsion layer:

Sodium 3,3'-di-(γ-sulfopropyl)-9-methylthiadicarbocyanine ($2.5\times10^{-4}$ mole per 1 mole of silver halide)

Each emulsion layer contained the following dye as an anti-irradiation dye:

Green-sensitive emulsion layer:

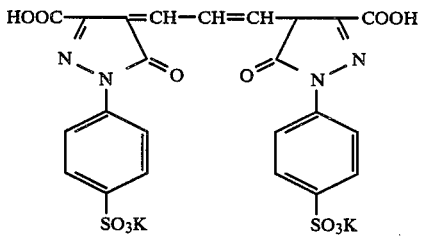

Red-sensitive emulsion layer:

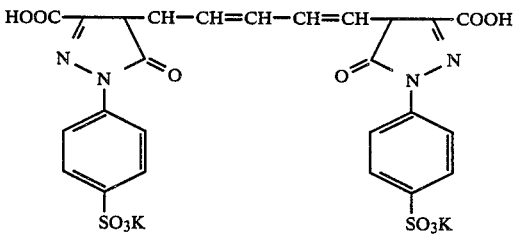

The thus-obtained photographic material was called sample No. 101.

Next, other sample Nos. 102 through 113 were formed in the same manner as the sample No. 101 with the exception that the green-sensitive layer was composed of the combination of the emulsion and the magenta coupler as shown in the following Table 1. The amount of the magenta coupler as coated was an equimolar amount of the coupler (M-58) as used in the sample No. 101. The silver amount in the green-sensitive layer was 0.45 g/m$^2$, in the cases where the tetra-equivalent magenta comparative coupler (E) was used.

The thus-formed samples were subjected to gradation exposure for sensitometry by the use of an enlarger (Fuji Color Head 609, by Fuji Photo Film Co.), and thereafter treated according to the treatment (A), treatment (B) and treatment (C).

In each of the thus-treated samples, "γ" was measured, which designated the inclination of the gradation of the photographic characteristic curve, "γ" being defined to be the inclination of the density as varying in accordance with the variation of the exposure amount of from the exposure to form the density of (fog density+0.2) to three times of the exposure, and the relative variation of the thus-obtained "γ" in the treatment (B) (where the amount of $Na_2SO_3$ was smaller) and in the treatment (C) (where the amount of $Na_2SO_3$ was larger), to the "γ" obtained in the treatment (A), was determined in each sample. The results were given in the following Table 2.

In addition, each sample was subjected to gradation exposure and thereafter subjected to the treatments (D) and (E) where 400 m$^2$ of each sample was treated. "γ" was analogously obtained from the characteristic curve in each case, and the relative variations of "γ" to that obtained by the use of a fresh treating solution (where "γ" is measured just after the preparation of the treating solution) was determined. The results were given in the following Table 3.

TABLE 1

| Sample No. | Emulsion Used | Magenta Couple Used | Note |
|---|---|---|---|
| 101 | Emulsion (A) | Coupler (M-58) | sample of the present invention |
| 102 | Emulsion (B) | Coupler (M-55) | sample of the present invention |
| 103 | Emulsion (B) | Coupler (M-56) | sample of the present invention |
| 104 | Emulsion (B) | Coupler (M-57) | sample of the present invention |
| 105 | Emulsion (B) | Coupler (M-58) | sample of the present invention |
| 106 | Comparative Emulsion (C) | Coupler (M-58) | comparative sample |
| 107 | Comparative Emulsion (D) | Coupler (M-58) | comparative sample |
| 108 | Emulsion (A) | Comparative Coupler (E) | comparative sample |
| 109 | Emulsion (B) | Comparative Coupler (E) | comparative sample |
| 110 | Emulsion (B) | Comparative Coupler (F) | comparative sample |
| 111 | Comparative Emulsion (C) | Comparative Coupler (E) | comparative sample |
| 112 | Comparative Emulsion (D) | Comparative Coupler (E) | comparative sample |
| 113 | Comparative Emulsion (D) | Comparative Coupler (F) | comparative sample |

TABLE 2

| Sample No. | Variation of γ | | |
|---|---|---|---|
| | Treatment (A) | Treatment (B) | Treatment (C) |
| 101 | 100 | 115 | 85 |
| 102 | " | 115 | 85 |
| 103 | " | 110 | 88 |
| 104 | " | 120 | 80 |
| 105 | " | 110 | 88 |
| 106 | " | 170 | 70 |
| 107 | " | 210 | 70 |
| 108 | " | 120 | 85 |
| 109 | " | 125 | 80 |
| 110 | " | 120 | 80 |
| 111 | " | 135 | 75 |
| 112 | " | 135 | 80 |
| 113 | : | 135 | 80 |

TABLE 3

| Sample No. | Variation of γ | |
|---|---|---|
| | Treatment (D) | Treatment (E) |
| 101 | 97 | 90 |
| 102 | 98 | 90 |
| 103 | 99 | 91 |
| 104 | 97 | 89 |
| 105 | 100 | 92 |
| 106 | 80 | 65 |
| 107 | 85 | 70 |
| 108 | 95 | 88 |
| 109 | 94 | 88 |
| 110 | 95 | 90 |
| 111 | 91 | 80 |
| 112 | 91 | 80 |
| 113 | 92 | 82 |

In order to test the light-fastness of the sample Nos. 101 through 113, a light-fastness test was carried out as follows: Each sample which had been subjected to gradation exposure followed by development was irradiated with a xenon lamp having an irradiation energy of 0.81 kJ/m$^2$ for 7 days, and the variation of the yellow stain and the variation of the magenta density in the places which had been subjected to a certain constant exposure were measured. The results are shown in the following Table 4.

The results shown in Table 2 and Table 3 prove that the silver halide photographic materials of the present invention (sample Nos. 101 through 105), which were obtained by the combination of the tabular silver halide grain-containing emulsion and the pyrazoloazole-type magenta coupler of the general formula (I), have stable photographic characteristics which hardly vary when subjected to different amounts of sodium sulfite contained in the developer or variations in the composition of the treating solutions which were fatigued due to the actual running treatment of a certain amount of the respective photographic materials. On the other hand, it is noted that the comparative samples (sample Nos. 106 and 107) obtained by the combination of the conventional emulsion and the pyrazoloazole-type coupler showed an extremely noticeable gradation variation. In particular, the variation was great in the sample No. 107 in which the content of silver chloride was larger, and it is apparent that the pyrazoloazole-type couplers are extremely easily affected by the shape of the silver halide emulsion used or the halogen composition thereof. Where the tabular grains of the present invention are used, the influence of the variation of the halogen composition on the photographic characteristics is small, as apparent from the composition between the samples 101 and 105.

On the other hand, in the cases where the conventional 5-pyrazolone-type coupler was used, the difference between the tabular grains and the block-like grains was small.

TABLE 4

| Sample No. | Variation of Yellow Stain | Variation of Magenta Density |
|---|---|---|
| 101 | +0.04 | −0.15 |
| 102 | +0.05 | −0.17 |
| 103 | +0.05 | −0.17 |
| 104 | +0.06 | −0.20 |
| 105 | +0.04 | −0.14 |
| 106 | +0.04 | −0.16 |
| 107 | +0.04 | −0.16 |
| 108 | +0.15 | −0.42 |
| 109 | +0.16 | −0.42 |
| 110 | +0.20 | −0.30 |
| 111 | +0.16 | −0.42 |
| 112 | +0.15 | −0.30 |
| 113 | +0.22 | −0.30 |

The above results prove that the combination of the pyrazoloazole-type coupler of the formula (I) and the tabular silver bromochloride emulsion can attain an excellent stabilization effect when subjected to varying treatment factors.

In addition, in the light-fastness test, the increase in the amount of the yellow stain and the decrease of the color image density are small in the sample Nos. 101 through 105 of the present invention, as shown in Table 4, and, therefore, the silver halide photographic materials of the present invention exhibit excellent color image-fastness.

Further, it is noted that the sample Nos. 101 through 105 in which the pyrazoloazole-type coupler of the formula (I) was used have a far higher color-reproducibility in the formed color images, as compared with the other comparative sample Nos. 106 through 113.

In conclusion, the effect of the present invention may be attained by the provision of the silver halide color photographic materials comprising the combination of the pyrazoloazole-type magenta coupler of the formula (I) and the tabular silver bromide or silver bromochloride grain-containing emulsion.

EXAMPLE 2

Blue-sensitive silver halide emulsion (E) was prepared as follows:

| | |
|---|---|
| Solution (1): | |
| $H_2O$ | 1,000 ml |
| NaCl | 5.5 g |
| Gelatin | 32 g |
| Solution (2): | |
| Sulfuric acid (1N) | 20 ml |
| Solution (3): | |
| Silver halide solvent (1%) represented by the following formula | 3 ml |

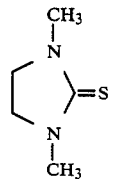

| | |
|---|---|
| Solution (4): | |
| KBr | 0.18 g |

-continued

| | |
|---|---|
| NaCl | 8.52 g |
| Water to make | 140 ml |
| Solution (5): | |
| $AgNO_3$ | 25 g |
| Water to make | 140 ml |
| Solution (6): | |
| KBr | 0.70 g |
| NaCl | 34.06 g |
| $K_2IrCl_6$(0.001%) | 3.6 g |
| Water to make | 320 ml |
| Solution (7): | |
| $AgNO_3$ | 100 g |
| Water to make | 320 ml |

Solution (1) was heated at 60° C., and then Solutions (2) and (3) were added to the heated Solution (1). Thereafter, Solutions (4) and (5) were gradually added at the same time for 1 hour. After 10 minutes, Solutions (6) and (7) were further gradually added at the same time for 25 minutes. After 5 minutes of addition, the temperature of the mixture was reduced to carry out a desalting.

Then, water and dispersed gelatin were added to the resulting mixture and a pH thereof was adjusted to 6.2 to obtain a cubic monodispersion silver bromochloride emulsion (containing 1 mol% of silver bromide) having an average grain size of 1.04 μm and a variation coefficient (standard deviation/average grain size: s/d) of 0.08.

To the obtained emulsion, sodium thiosulfate was added, and then suitably subjected to a chemical-sensitization.

The emulsion contained the following spectral-sensitizer in an amount of $7.0\times10^{-4}$ mole per 1 mole of silver halide, and then subjected to a spectral-sensitization.

(E) Spectral-sensitizer for blue-sensitive emulsion layer

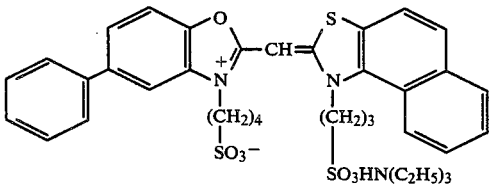

Green-sensitive silver halide emulsion and red-sensitive emulsion were prepared according to the following procedures.

The silver halide emulsion (F) was prepared as follows:

| | |
|---|---|
| Solution (8): | |
| $H_2O$ | 1000 ml |
| NaCl | 2.6 g |
| Gelatin | 32 g |

-continued

| | |
|---|---|
| Solution (9): | |
| Sulfuric acid (1N) | 20 ml |
| Solution (10): | |
| Silver halide solvent (1%) of Solution (3) | 3 ml |
| Solution (11): | |
| KBr | 0.18 g |
| NaCl | 8.52 g |
| Water to make | 140 ml |
| Solution (12): | |
| $AgNO_3$ | 25 g |
| Water to make | 140 ml |
| Solution (13): | |
| KBr | 0.70 g |
| NaCl | 34.06 g |
| $K_2IrCl_6$ (0.001%) | 3.6 ml |
| Water to make | 320 ml |
| Solution (14): | |
| $AgNO_3$ | 100 g |
| Water to make | 320 ml |

Solution (8) was heated at 60° C., and then Solutions (9) and (10) were added to the heated Solution (8). Thereafter Solutions (11) and (12) were gradually added at the same time for 8 minutes. After 10 minutes, Solutions (13) and (14) were further gradually added at the same time for 20 minutes. After 5 minutes of addition, the temperature of the mixture was reduced to carry out a desalting.

Then, water and dispersed gelatin were added to the resulting mixture and a pH thereof was adjusted to 6.2 to obtain a cubic monodispersion silver bromochloride emulsion (containing 1 mol% of silver bromide) having an average grain size of 0.47 μm and variation coefficient of 0.07.

To the obtained emulsion, chloroauric acid and sodium thiosulfate were added, and then suitably subjected to a chemical-sensitization.

Further, a cubic monodispersion silver bromochloride emulsion (G) (containing 1 mol% of silver bromide) having an average grain size of 0.34 μm and variation coefficient of 0.06 was obtained in the same procedure as in the emulsion (F) with the exception that the temperature was changed.

The emulsions (F) and (G) contained the following spectral-sensitizers to obtain green-sensitive and red-sensitive emulsion layer. In each emulsion layer, the emulsions (F) and (G) were mixed in the proportion of 3:7, respectively.

Spectral-sensitizer for green-sensitive emulsion layer

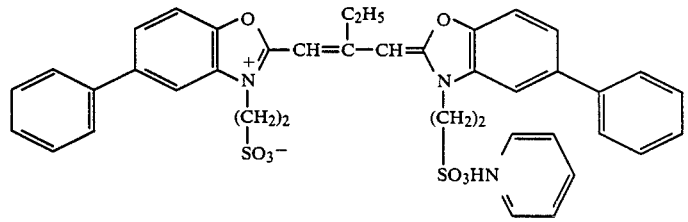

($4\times10^{-4}$ mole per 1 mole of silver halide)

Spectral-sensitizer for red-sensitive emulsion layer

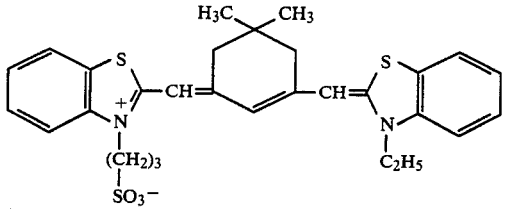

($2\times10^{-4}$ mole per 1 mole of silver halide)

The emulsion (H) of the present invention was prepared as follows:

| | |
|---|---|
| Solution (15): | |
| $H_2O$ | 1,000 cc |
| NaCl | 11.0 g |
| Gelatin | 30.0 g |
| Solution (16): | |
| Compound (5%) represented by the following formula | 20,0 cc |

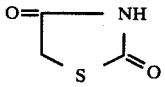

| | |
|---|---|
| Solution (17): | |
| $AgNO_3$ | 10.0 g |
| Water to make | 200 cc |
| Solution (18): | |
| KBr | 0.70 g |
| NaCl | 4.50 g |
| water to make | 200 cc |
| Solution (19): | |
| $AgNO_3$ | 90.0 g |
| Water to make | 600 cc |
| Solution (20): | |
| KBr | 0.63 g |
| NaCl | 4.50 g |
| Water to make | 600 cc |

Solution (15) was heated at 50° C., and then Solution (16) was added to the heated Solution (15). Thereafter, Solutions (17) and (18) were gradually added at the same time for 3 minutes. After 10 minutes, Solutions (19) and (20) were increasingly added at the same time for 20 minutes in an amount such that the final addition amount was three times the initial addition amount. After 5 minutes of addition the temperature of the mixture was reduced to carry out a desalting.

Then, water and dispersed gelatin were added to the resulting mixture and a pH thereof was adjusted to 6.2 to obtain a tabular silver homochloride emulsion (containing 1 mol% of silver bromide) having an average grain size of 0.40 μm and a variation coefficient of 0.19.

To the obtained emulsion, chloroauric acid and sodium thiosulfate were added, and then suitably subjected to a chemical-sensitization.

The emulsion contained same spectral-sensitizers as in the emulsions (F) and (G), and then subjected to a green-sensitive spectral-sensitization.

The emulsion contained tabular silver halide grains in an amount of 85% of the total projected area of all the grains therein, and the average aspect ratio thereof was 7.

Sample Nos. 201 through 208 were formed in the same manner as in Example 1 with the exception that the emulsion and magenta coupler were combined as shown in the following Table 5. The magenta coupler used is same as in Example 1.

Thus-formed samples were subjected to gradation exposure in the same procedure as in Example 1, and thereafter treated according to the treatment (F), treatment (G) and treatment (H).

In each of the thus-treated samples, "γ" was measured from the gradation of the obtained photographic characteristic curve, and the relative variation of the thus-obtained "γ" in the treatment (G) and in the treatment (H) to the "γ" obtained in the treatment (F), was determined in each sample. The results were given in the following Table 6.

Treatment (F):

| Treatment step | Temperature | Time |
|---|---|---|
| Development | 35° C. | 45 sec. |
| Bleaching-fixation | 35° C. | 45 sec. |
| Rinsing | 35° C. | 90 sec. |

Composition of treating solution, color developer (F):

| Components | |
|---|---|
| Water | 800 ml |
| Diethylenetriamine-pentaacetate | 1.0 g |
| Sodium sulfite | 0.2 g |
| N,N—diethylhydroxylamine | 4.2 g |
| Potassium bromide | 0.01 g |
| Sodium chloride | 1.5 g |
| Triethanolamine | 8.0 g |
| Potassium carbonate | 30 g |
| N—ethyl-N—(β-methanesulfonamido-ethyl)-3-methyl-4-aminoaniline sulfate | 4.5 g |
| 4,4'-diaminostilbene type fluorescent whitening agent (Whitex 4 manufactured by Sumitomo Chemical Company, Limted) | 2.0 g |
| Water to make | 1000 ml |

pH was adjusted to be 10.05 with KOH.

Bleaching fixing solution (F):

| | |
|---|---|
| EDTA Fe(III)$NH_4$.$2H_2O$ | 60 g |
| EDTA 2Na.$2H_2O$ | 4.0 g |
| Ammonium thiosulfate (70%) | 120 ml |
| Sodium sulfite | 16 g |
| Acetaldehyde sulfite addition product | 10 g |
| Glacial acetic acid | 7 g |
| Water to make | 1000 ml |
| pH | 5.50 |

Rinsing solution (F):

| | |
|---|---|
| EDTA2Na.$2H_2O$ | 4.0 g |
| Water to make | 1000 ml |
| pH | 7.00 |

The treatment (G) and treatment (H) were carried out in the same manner as in treatment (F) with the exception that the amounts of sodium sulfite in color developer (F) were changed to 0.01 g and 1.0 g, respectively.

TABLE 5

| Sample No. | Emulsion Used | Magenta Coupler Used | Note |
|---|---|---|---|
| 201 | F + G | Coupler (M-55) | Comparison |
| 202 | " | Coupler (M-56) | " |

TABLE 5-continued

| Sample No. | Emulsion Used | Magenta Coupler Used | Note |
|---|---|---|---|
| 203 | " | Coupler (M-57) | " |
| 204 | " | Coupler (M-58) | " |
| 205 | H | Coupler (M-55) | This Invention |
| 206 | " | Coupler (M-56) | " |
| 207 | " | Coupler (M-57) | " |
| 208 | " | Coupler (M-58) | " |

TABLE 6

| Sample No. | Variation of γ (Relative Value to Treatment (F)) Treatment (F) | Treatment (G) | Treatment (H) | Note |
|---|---|---|---|---|
| 201 | 100 | 102 | 79 | Comparison |
| 202 | 100 | 103 | 80 | " |
| 203 | 100 | 102 | 80 | " |
| 204 | 100 | 102 | 79 | " |
| 205 | 100 | 102 | 85 | This Invention |
| 206 | 100 | 102 | 87 | This Invention |
| 207 | 100 | 103 | 86 | This Invention |
| 208 | 100 | 102 | 85 | This Invention |

From the results shown in Table 6, it can be seen that the silver halide color photographic material comprising the combination of pyrazoloazole-type magenta coupler of the formula (I) and the tabular silver bromide or silver bromochloride grain-containing emulsion provides the improved dependence on the treatment as in Example 1.

Further, the samples were evaluated for the light-fastness test in the same manner as in Example 1. In the light-fastness test, it has been formed that the stability of the color image in the sample Nos. 205 to 208 is excellent, and the color-reproducibility in the formed color images is also excellent as compared with the other comparative samples.

While the invention has been described in detail and with reference to specific embodiments thereof, it will be apparent to one skilled in the art that various changed and modifications can be made therein without departing from the spirit and scope thereof.

What is claimed is:

1. A silver halide color photographic material comprising at least one silver halide emulsion layer on a support, wherein said emulsion layer contains silver halide grains comprising silver bromide or silver bromochloride, about 50% or more of the total projected area of said silver halide grains comprise tabular grains, and said emulsion layer further contains at least one pyrazoloazole-type magenta coupler represented by general formula (I):

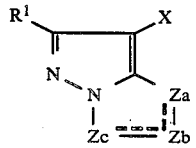

(I)

wherein $R^1$ represents a hydrogen atom or a substituent;

X represents a hydrogen atom or a group capable of being removed by a coupling reaction with an oxidized form of an aromatic primary amine developing agent;

Zb and Zc each represents a methine or substituted methine residue or =N— or —NH;

Za represents =N— or —NH—;

one of the Za-Zb bond and the Zb-Zc bond is double bond, and the other is a single bond; and if the Zb-Zc bond is a carbon-carbon double bond, this may form a part of an aromatic ring;

$R^1$ or X may form a dimer or a polymer; and if Zb or Zc is a substituted methine residue, this may form a dimer or a polymer, wherein the tabular silver halide grains have a grain diameter of 0.2-5.0 μm, a grain thickness of about 0.3 μm or less and an average aspect ratio of 5 to 8, and wherein when the tabular silver halide grains in the emulsion layer comprise silver bromochloride they contain about 40 to about 95 mol % of silver bromide.

2. The silver halide color photographic material as claimed in claim 1, wherein the proportion of the tabular silver halide grains in the projected area of the total silver halide grains in the emulsion is about 70% or more.

3. The silver halide color photographic material as claimed in claim 2, wherein the proportion of the tabular silver halide grains in the projected area of the total silver halide grains in the emulsion is 85% or more.

4. The silver halide color photographic material as claimed in claim 1, wherein the diameter of the tabular silver halide grains is from 0.3 μm to 2.0 μm.

5. The silver halide color photographic material as claimed in claim 1, wherein the proportion of the tabular silver halide grains in the projected area of the total silver halide grains in the emulsion is 85% or more and the tabular grains have a grain diameter of 0.3 to 2.0 μm and an average aspect ratio of about 5 or more.

6. The silver halide color photographic material as claimed in claim 1, wherein the tabular silver halide grains in the emulsion are chemically sensitized.

7. The silver halide color photographic material as claimed in claim 6, wherein the tabular silver halide grains in the emulsion are chemically sensitized by sulfur-sensitization, reductive sensitization and/or noble metal-sensitization.

8. The silver halide color photographic material as claimed in claim 1, wherein the tabular silver halide grains in the emulsion is spectrally-sensitized.

9. The silver halide color photographic material as claimed in claim 1, wherein the pyrazoloazole-type magenta coupler is selected from the group of compounds represented by the following formulae (II), (III), (IV), (V) and (VI):

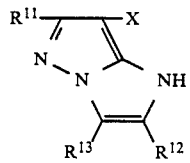

(II)

-continued (III)

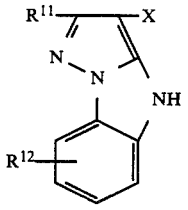

(IV)

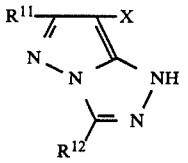

(V)

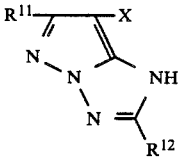

(VI)

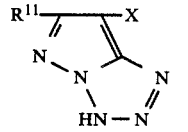

wherein $R^{11}$, $R^{12}$ and $R^{13}$ may be the same or different and each represents a hydrogen atom, a halogen atom, an alkyl group, an aryl group, a heterocyclic group, a cyano group, an alkoxy group, an aryloxy group, a heterocyclic-oxy group, an acyloxy group, a carbamoyloxy group, a silyloxy group, a sulfonyloxy group, an acylamino group, an anilino group, an ureido group, an imide group, a sulfamoylamino group, a carbamoylamino group, an alkylthio group, an arylthio group, a heterocyclic-thio group, an alkoxycarbonylamino group, an aryloxycarbonylamino group, a sulfonamide group, a carbamoyl group, an acyl group, a sulfamoyl group, a sulfonyl group, a sulfinyl group, an alkoxycarbonyl group or an aryloxycarbonyl group; X represents a hydrogen atom, a halogen atom or a carboxyl group or represents a group which is bonded with the carbon atom in the coupling-position via an oxygen atom, nitrogen atom or sulfur atom and which may be removed by a coupling reaction; and $R^{11}$, $R^{12}$, $R^{13}$ or X may form a dimer or a polymer.

10. The silver halide color photographic material as claimed in claim 1 or claim 9, wherein the pyrazoloazole-type magenta coupler is selected from the couplers Nos. (M-1) through (M-58) as listed hereafter:

(M-1)

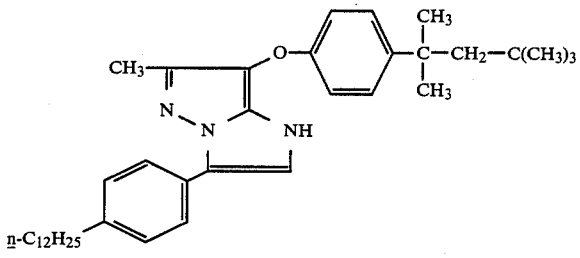

(M-2)

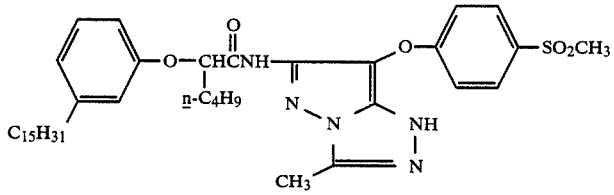

(M-3)

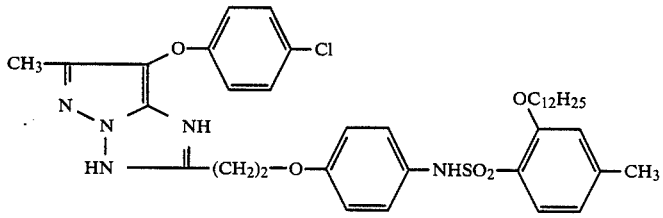

-continued
(M-4)
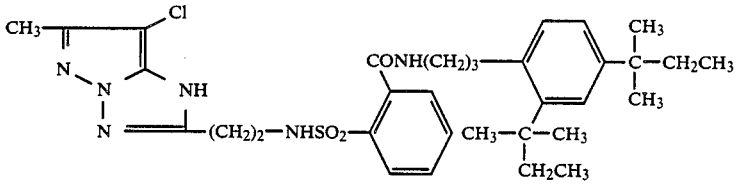
(M-5)
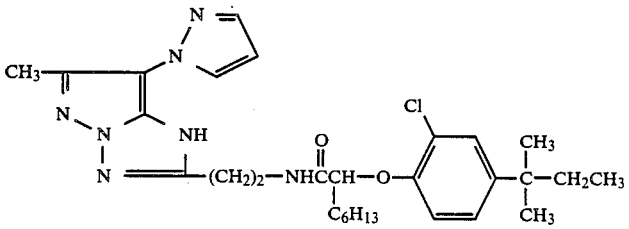
(M-6)
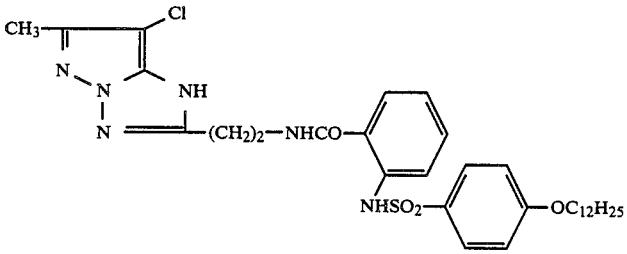
(M-7)
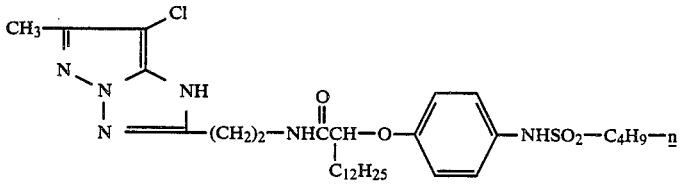
(M-8)
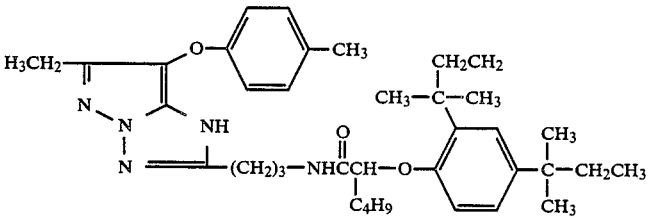
(M-9)
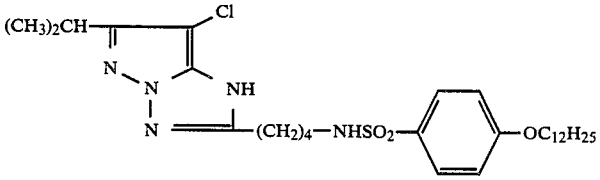
(M-10)
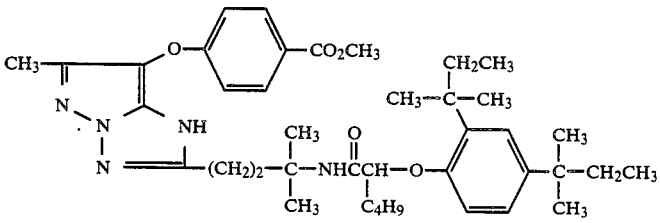

-continued
(M-11)
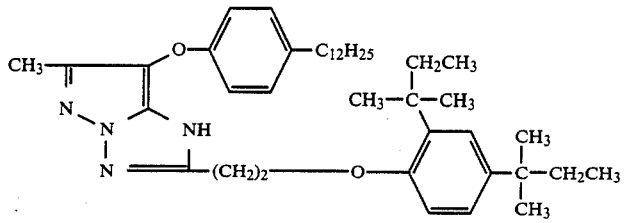
(M-12)
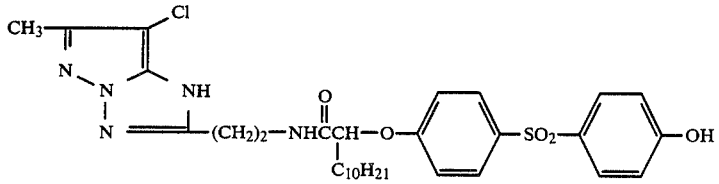
(M-13)
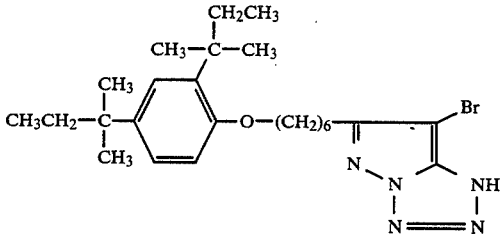
(M-14)
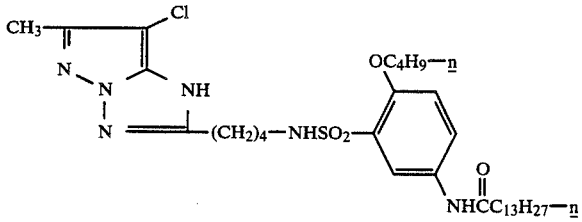
(M-15)
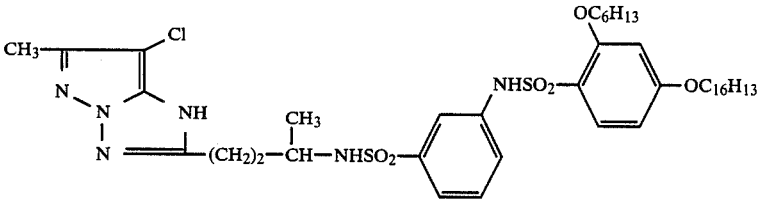
(M-16)
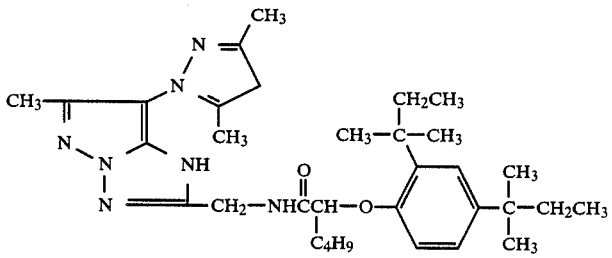
(M-17)
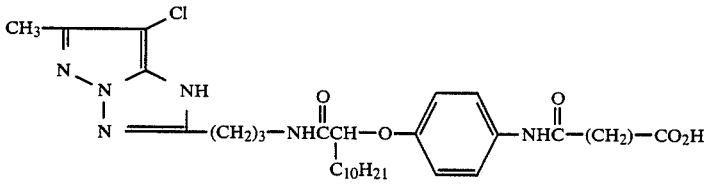

-continued
(M-18)
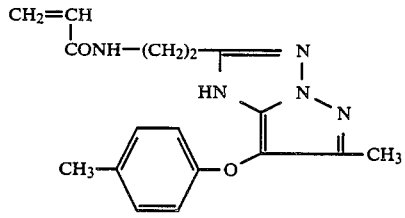
(M-19)
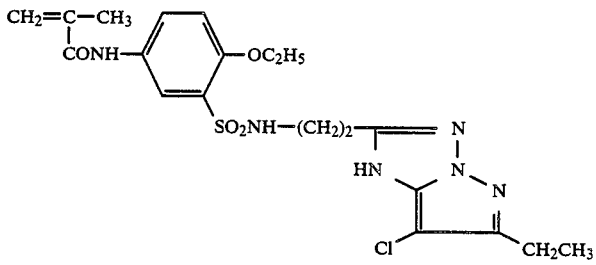
(M-20)
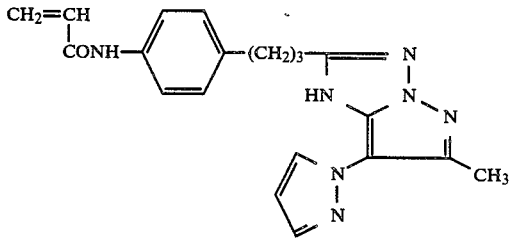
(M-21)
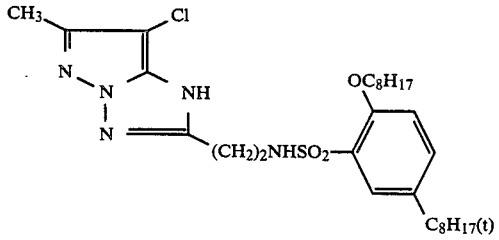
(M-22)
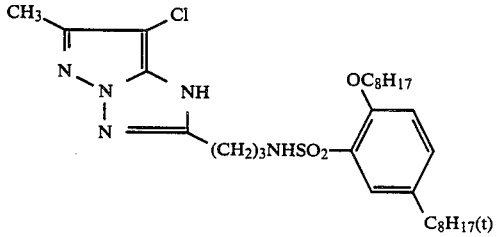
(M-23)
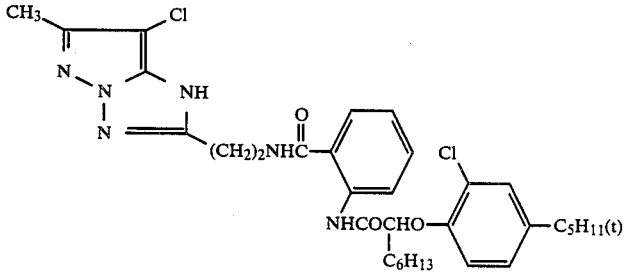

-continued
(M-24)
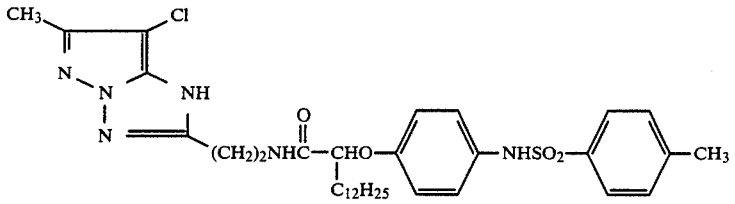
(M-25)
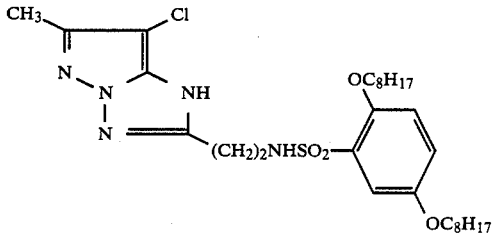
(M-26)
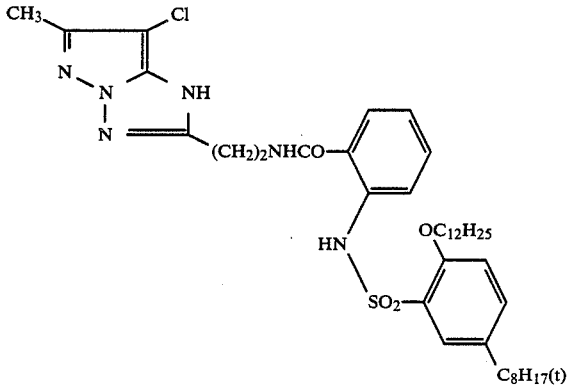
(M-27)
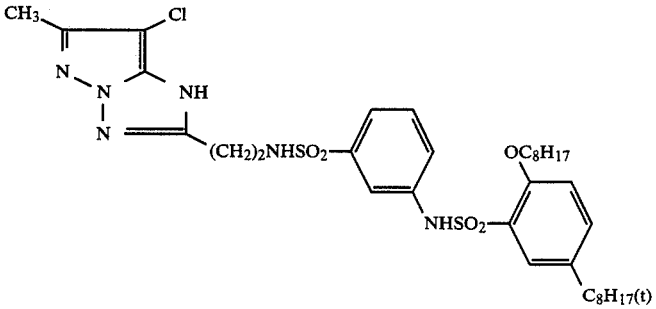
(M-28)
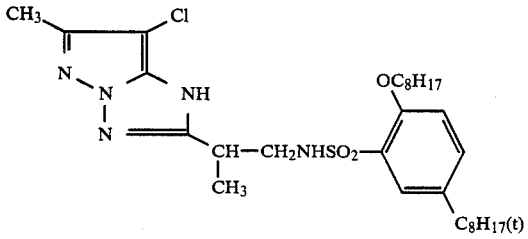
(M-29)
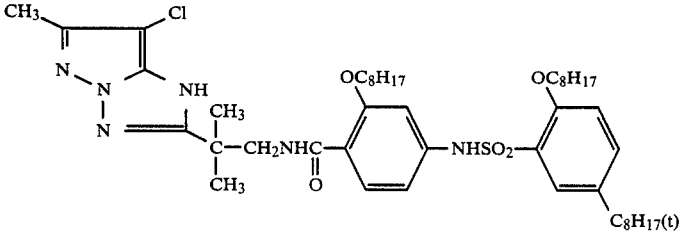

-continued
(M-30)
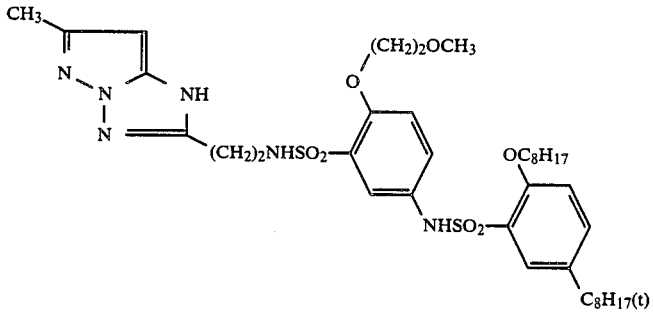
(M-31)
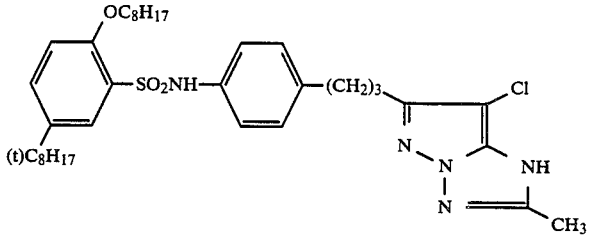
(M-32)
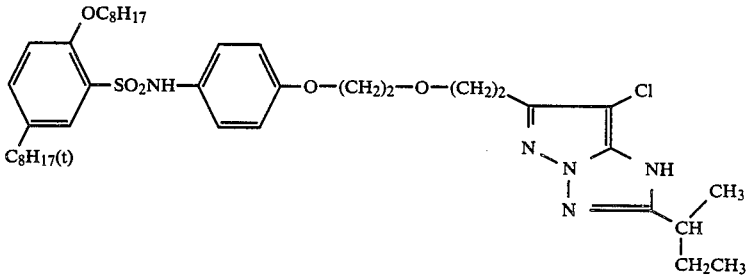
(M-33)
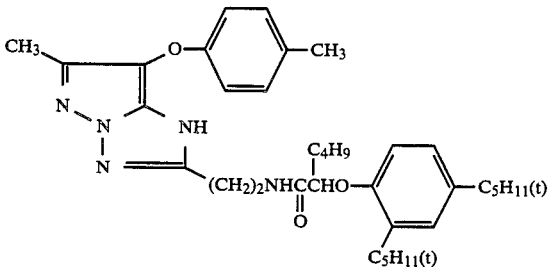
(M-34)
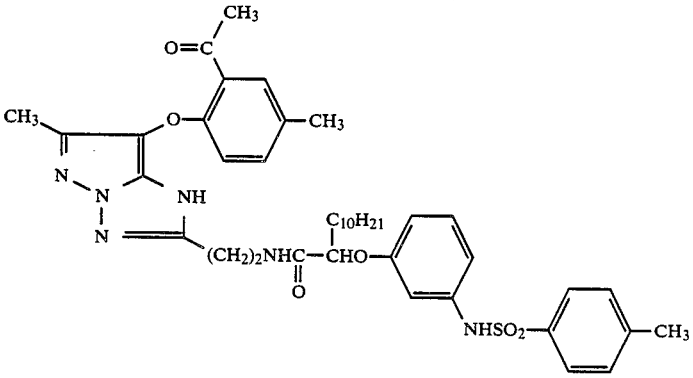

-continued
(M-35)
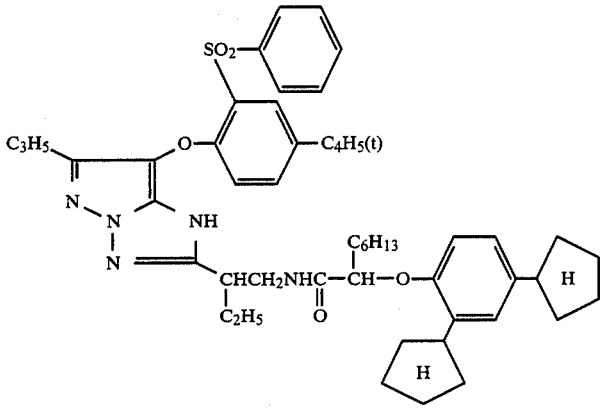
(M-36)
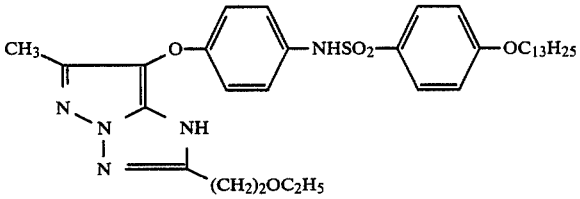
(M-37)
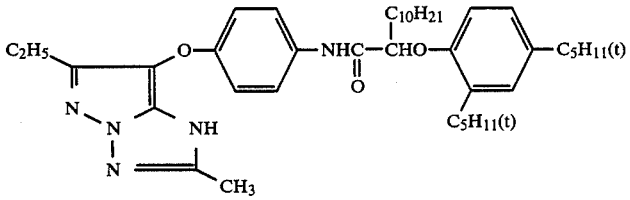
(M-38)
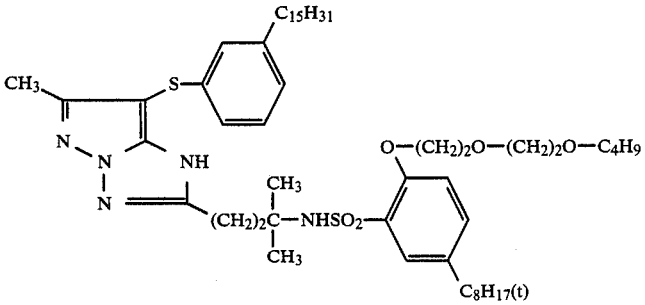
(M-39)
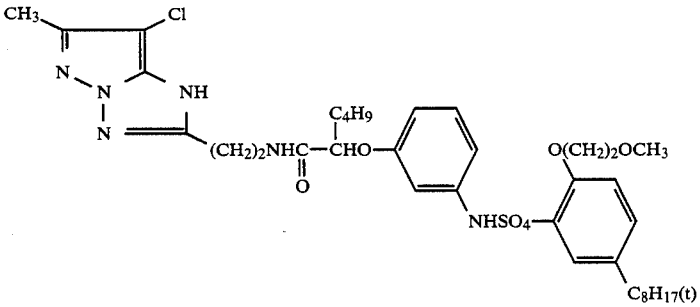

-continued
(M-40)
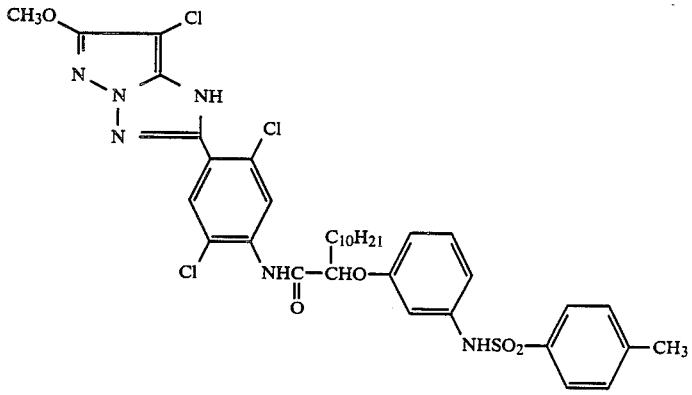
(M-41)
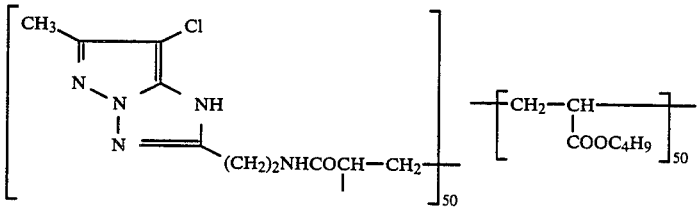
(M-42)
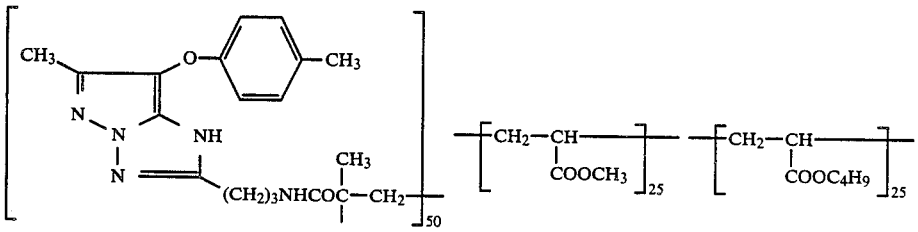
(M-43)
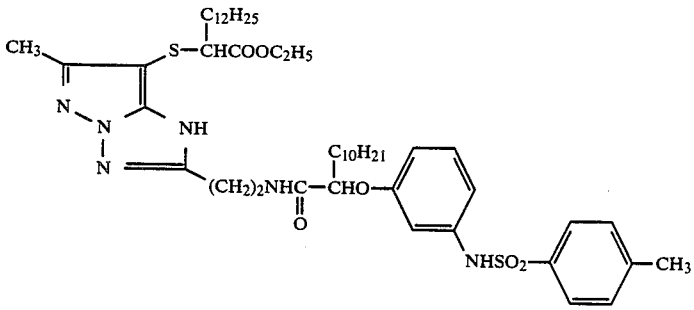
(M-44)
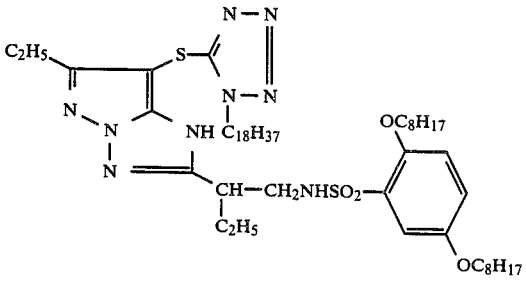

-continued
(M-45)
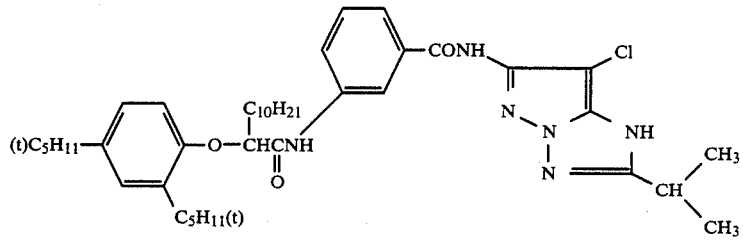
(M-46)
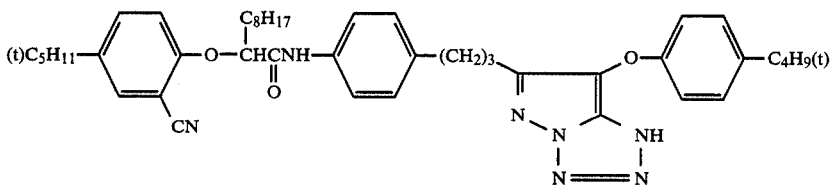
(M-47)
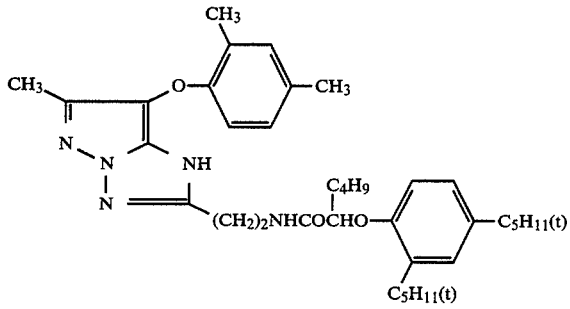
(M-48)
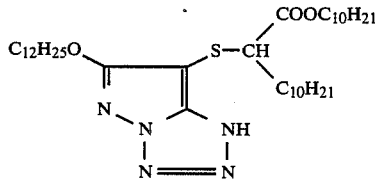
(M-49)
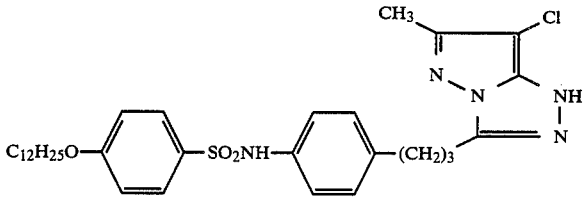
(M-50)
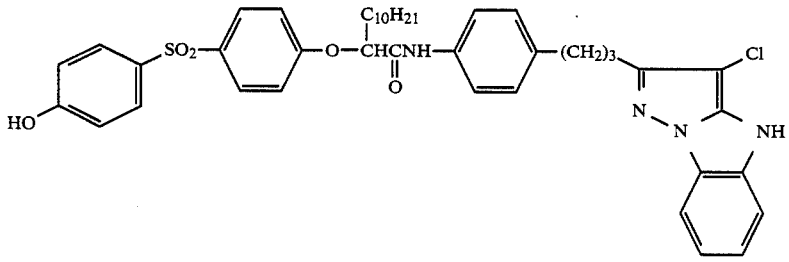

-continued
(M-51)
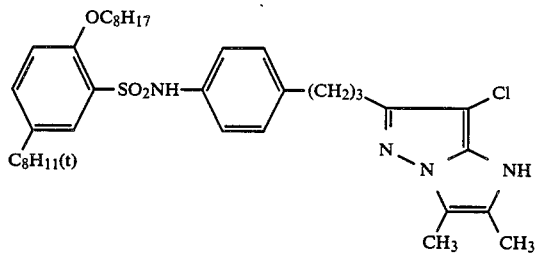
(M-52)
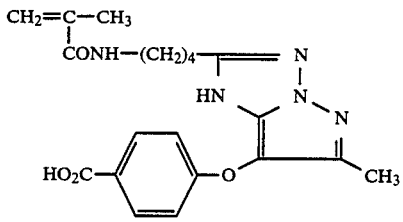
(M-53)
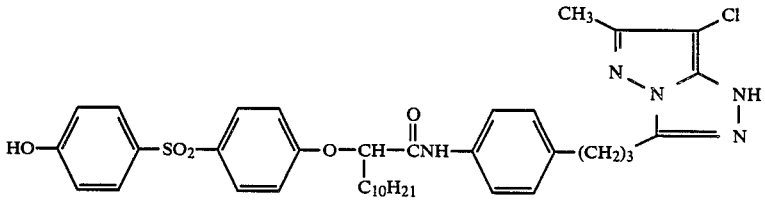
(M-54)
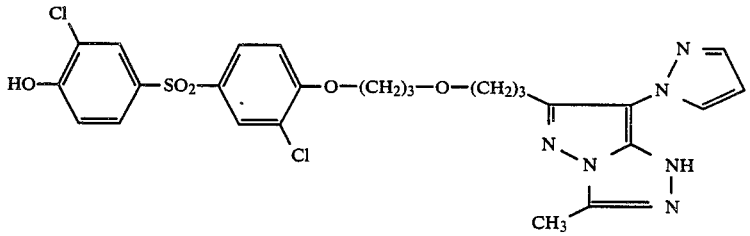
(M-55)
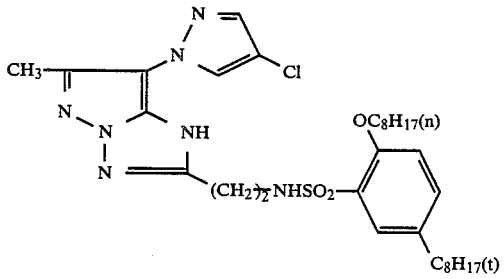
(M-56)
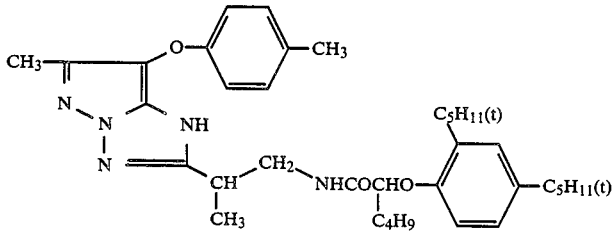

-continued
(M-57)
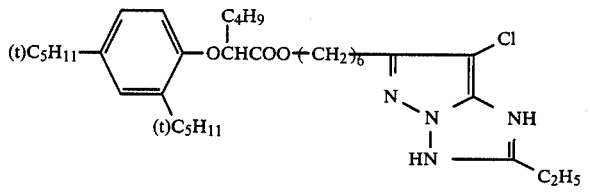
(M-58)
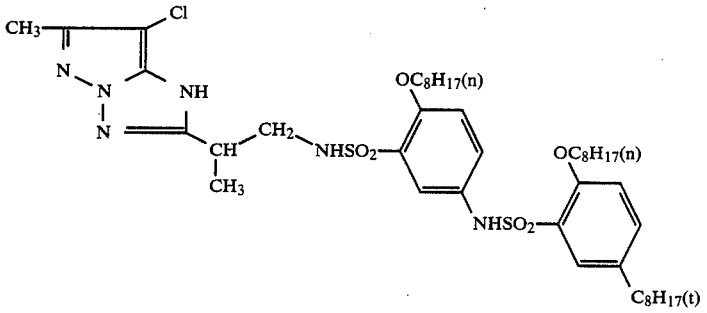
11. The silver halide color photographic material as claimed in claim 1, wherein the tabular silver halide grains and the emulsion layer have an average aspect ratio of 5 to 7.
* * * * *